US010230205B2

(12) United States Patent
Gatnau Navarro et al.

(10) Patent No.: US 10,230,205 B2
(45) Date of Patent: Mar. 12, 2019

(54) TELECOMMUNICATIONS JACK WITH SWITCHABLE CIRCUIT CONFIGURATIONS

(71) Applicant: CommScope Connectivity Spain, S.L., Alcobendas, Madrid (ES)

(72) Inventors: Jorge Gatnau Navarro, Barcelona (ES); Arturo Pachón, Badalona (ES); Maria Maqueda Gonzalez, Barcelona (ES); Albert Font Aranega, Badalona (ES); Jose Jamie Sanabra Jansa, Vilanova i la Geltrú (ES)

(73) Assignee: CommScope Connectivity Spain, S.L., Alcobendas, Madrid (ES)

( * ) Notice: Subject to any disclaimer, the term of this patent is extended or adjusted under 35 U.S.C. 154(b) by 0 days.

(21) Appl. No.: 15/389,579

(22) Filed: Dec. 23, 2016

(65) Prior Publication Data

US 2017/0264061 A1 Sep. 14, 2017

Related U.S. Application Data

(63) Continuation of application No. 14/210,116, filed on Mar. 13, 2014, now Pat. No. 9,531,135.
(Continued)

(51) Int. Cl.
*H01R 24/00* (2011.01)
*H01R 29/00* (2006.01)
(Continued)

(52) U.S. Cl.
CPC ..... *H01R 29/00* (2013.01); *H01R 13/17* (2013.01); *H01R 13/6466* (2013.01);
(Continued)

(58) Field of Classification Search
CPC ..... H01R 23/025; H01R 2103/00; H01R 13/7032
(Continued)

(56) References Cited

U.S. PATENT DOCUMENTS 5,346,405 A 9/1994 Mosser, III et al.
6,056,568 A 5/2000 Arnett
(Continued)

FOREIGN PATENT DOCUMENTS

EP 1 858 125 A1 11/2007

OTHER PUBLICATIONS

International Search Report and Written Opinion for PCT/ES2014/070189 dated Jun. 23, 2014.

*Primary Examiner* — Hae Moon Hyeon
(74) *Attorney, Agent, or Firm* — Merchant & Gould P.C.

(57) ABSTRACT

Telecommunications jacks and methods of their use and construction are described. One telecommunications jack is adapted to receive a plug, and includes a housing defining a port for receiving the plug, as well as consecutively arranged contact springs adapted to make electrical contact with the plug when the plug is inserted into the port of the housing along a first axis. The jack includes wire termination contacts for terminating wires to the jack, and a circuit board arrangement including first and second circuits, the circuit board arrangement including a circuit board moveable in a direction non-parallel with the first axis between first and second positions. In the first position the circuit board electrically connects contact springs to wire termination contacts in a first configuration, and in the second position the circuit board connects contact springs to wire termination contacts in a second configuration.

10 Claims, 35 Drawing Sheets

Related U.S. Application Data

(60) Provisional application No. 61/789,288, filed on Mar. 15, 2013.

(51) Int. Cl.

| | |
|---|---|
| ***H01R 13/66*** | (2006.01) |
| ***H01R 43/00*** | (2006.01) |
| ***H01R 13/6466*** | (2011.01) |
| ***H01R 13/6469*** | (2011.01) |
| ***H01R 13/703*** | (2006.01) |
| ***H01R 24/64*** | (2011.01) |
| ***H01R 13/17*** | (2006.01) |
| ***H01R 13/719*** | (2011.01) |
| *H01R 107/00* | (2006.01) |

(52) U.S. Cl.
CPC ..... *H01R 13/6469* (2013.01); *H01R 13/665* (2013.01); *H01R 13/6658* (2013.01); *H01R 13/7039* (2013.01); *H01R 13/719* (2013.01); *H01R 24/64* (2013.01); *H01R 43/00* (2013.01); *H01R 2107/00* (2013.01); *Y10T 29/49117* (2015.01)

(58) Field of Classification Search
USPC ..... 439/620.01, 676, 188
See application file for complete search history.

(56) References Cited

U.S. PATENT DOCUMENTS

| | | | | |
|---|---|---|---|---|
| 6,074,256 | A | 6/2000 | Arnett | |
| 6,079,996 | A | 6/2000 | Arnett | |
| 6,156,981 | A | 12/2000 | Ward et al. | |
| 6,162,077 | A | 12/2000 | Laes et al. | |
| 6,244,908 | B1 | 6/2001 | Hammond et al. | |
| 6,296,528 | B1 | 10/2001 | Roberts et al. | |
| 6,358,093 | B1 | 3/2002 | Phommachanh et al. | |
| 6,371,780 | B1 | 4/2002 | Aponte et al. | |
| 6,394,853 | B1 | 5/2002 | Hammond et al. | |
| 6,739,892 | B1 | 5/2004 | Belopolsky et al. | |
| 7,381,098 | B2 | 6/2008 | Hammond, Jr. et al. | |
| 7,402,085 | B2 | 7/2008 | Hammond, Jr. et al. | |
| 7,611,383 | B1 | 11/2009 | Huang | |
| 7,787,615 | B2 | 8/2010 | Hammond, Jr. et al. | |
| 7,850,492 | B1 | 12/2010 | Straka et al. | |
| 8,151,457 | B2 | 4/2012 | Hammond, Jr. et al. | |
| 8,944,855 | B2 * | 2/2015 | Bolouri-Saransar | H01R 13/6461 439/218 |
| 9,531,135 | B2 * | 12/2016 | Gatnau Navarro | H01R 13/665 |
| 2009/0186532 | A1 | 7/2009 | Goodrich et al. | |
| 2013/0090011 | A1 * | 4/2013 | Bolouri-Saransar | H01R 13/6461 439/620.15 |
| 2015/0056824 | A1 * | 2/2015 | Bolouri-Saransar | H01R 4/24 439/64 |

* cited by examiner

TELECOMMUNICATIONS JACK WITH SWITCHABLE CIRCUIT CONFIGURATIONS

CROSS-REFERENCE TO RELATED APPLICATIONS

This application is a continuation of application Ser. No. 14/210,116, filed Mar. 13, 2014, which application claims the benefit of provisional application Ser. No. 61/789,288, filed on Mar. 15, 2013, which applications are incorporated herein by reference in their entirety.

TECHNICAL FIELD

The present application relates generally to telecommunications systems. In particular, the present application relates generally to a telecommunications jack having switchable circuit configurations.

Background In the field of data communications, communications networks typically utilize techniques designed to maintain or improve the integrity of signals being transmitted via the network ("transmission signals"). To protect signal integrity, the communications networks should, at a minimum, satisfy compliance standards that are established by standards committees, such as the Institute of Electrical and Electronics Engineers (IEEE). The compliance standards help network designers provide communications networks that achieve at least minimum levels of signal integrity as well as some standard of compatibility.

One prevalent type of communication system uses twisted pairs of wires to transmit signals. In twisted pair systems, information such as video, audio and data are transmitted in the form of balanced signals over a pair of wires. The transmitted signal is defined by the voltage difference between the wires.

Crosstalk can negatively affect signal integrity in twisted pair systems. Crosstalk is unbalanced noise caused by capacitive and/or inductive coupling between wires and a twisted pair system. Communications networks include areas that are especially susceptible to crosstalk because of the proximity of the transmission signals. In particular, communications networks include connectors that bring transmission signals in close proximity to one another. For example, the contacts of traditional connectors (e.g., jacks and plugs) used to provide interconnections in twisted pair telecommunications systems are particularly susceptible to crosstalk interference.

Existing jacks and plugs include crosstalk compensating arrangements that are designed to reduce crosstalk for a range of frequencies intended to be used by the jack for data communications. Such crosstalk compensating arrangements are typically useable across a known range of frequencies to reduce crosstalk to levels that are acceptable according to known standards. For example, Category 5-compatible jack and plug arrangements are intended to be operable at about 100 MHz, and supports up to 1000BASE-T communication rates. In contrast, Category 6a-compatible cable supports up to about 500 MHz signal frequencies, and 10 Gigabit (10GBASE-T) data communication rates. Existing circuits useable to compensate for crosstalk in these circuits are operable across this entire range of frequencies.

As data rates continue to increase, still higher frequencies are required for communication, leading to signal frequencies needed that are in excess of 500 MHz, and up to about 1000 MHz. However, existing crosstalk compensation arrangements do not provide sufficient crosstalk compensation at these increased frequencies. Although some circuits exist that are intended to provide crosstalk compensation at these higher frequencies, those circuits have drawbacks. For example, because one goal of such a communication network is backward-compatibility, it is desired for the same jack to be useable in connection with higher frequency signals, while maintaining acceptable crosstalk levels for lower, preexisting frequencies.

Some existing attempts to address this issue involve use of differently formatted plugs and jacks for higher frequency signals. Such jacks include a jack compatible with the IEC 60603-7-7 interface standard, which in contrast to existing RJ-45 jacks, separates the middle two pairs of a four-pair connector and places a differential pair at each of four corners of a plug-jack combination. This physical separation of pairs reduces crosstalk among the pairs for higher frequency applications. In other solutions, a physical switch can be incorporated into a jack and that is actuated by a special-purpose plug. The physical switch can activate a higher-frequency compensation circuit, whereas in the absence of its actuation, existing crosstalk compensation frequencies are provided. However, even these arrangements have limitations in terms of the types of circuits useable, and are susceptible to switch failure.

For these and other reasons, improvements are desirable.

SUMMARY

In accordance with the following disclosure, the above and other issues are addressed by the following:

In a first aspect, a telecommunications jack adapted to receive a plug includes a housing defining a port for receiving the plug, and first, second, third, fourth, fifth, sixth, seventh and eighth consecutively arranged contact springs adapted to make electrical contact with the plug when the plug is inserted into the port of the housing along a first axis. The jack includes first, second, third, fourth, fifth, sixth, seventh and eighth wire termination contacts for terminating wires to the jack, and a circuit board arrangement including first and second circuits, the circuit board arrangement including a circuit board moveable in a direction non-parallel with the first axis between first and second positions. In in the first position the circuit board electrically connects a plurality of the contact springs to a corresponding plurality of the wire termination contacts via the first circuit, and in the second position the circuit board electrically connects the plurality of contact springs to the corresponding plurality of wire termination contacts via the second circuit different from the first circuit.

In a second aspect, a telecommunications jack adapted to receive a plug includes a housing defining a port, and first, second, third, fourth, fifth, sixth, seventh and eighth consecutively arranged contact springs adapted to make electrical contact with an RJ-45 plug when the RJ-45 plug is inserted into the port of the housing along a direction defined by a first axis. The jack also includes ninth, tenth, eleventh, and twelfth contact springs positioned apart from the first, second, third, fourth, fifth, sixth, seventh and eighth consecutively arranged contact springs and adapted to make electrical contact with an IEC 60603-7-7-compliant plug when the plug is inserted into the port. The jack includes first, second, third, fourth, fifth, sixth, seventh and eighth wire termination contacts for terminating wires to the device, and a circuit board arrangement including first and second circuits, the circuit board arrangement including a circuit board moveable in a direction non-parallel from the first axis and between first and second positions. In the first position the circuit board electrically connects at least the third, fourth, fifth, and sixth contact springs to the third, fourth, fifth, and sixth wire termination contacts via a first circuit, and in the second position the circuit board electrically connects the ninth, tenth, eleventh, and twelfth contact springs to the third, fourth, fifth, and sixth wire termination contacts via a second circuit on the circuit board different from the first circuit.

In a third aspect, a method of using a telecommunications jack includes inserting a plug into a port of a housing of the jack to engage first, second, third, fourth, fifth, sixth, seventh and eighth consecutively arranged contact springs, thereby engaging a circuit board arrangement including a circuit board moveable in a direction nonparallel with a first axis defining a direction of insertion of the plug between first and second positions, the jack including first, second, third, fourth, fifth, sixth, seventh and eighth wire termination contacts for terminating wires to the jack. In the first position the circuit board electrically connects the third, fourth, fifth, and sixth contact springs to the third, fourth, fifth, and sixth wire termination contacts via the first circuit, and in the second position the circuit board electrically connects the third, fourth, fifth, and sixth contact springs to the third, fourth, fifth, and sixth wire termination contacts via the second circuit different from the first circuit.

In a fourth aspect, a method of using a telecommunications jack includes inserting a plug into a port of a housing of the jack to engage first, second, third, fourth, fifth, sixth, seventh and eighth consecutively arranged contact springs, thereby engaging a circuit board arrangement including a circuit board moveable along a direction nonparallel with a first axis defined as a direction of insertion of the plug between first and second positions, the jack including first, second, third, fourth, fifth, sixth, seventh and eighth wire termination contacts for terminating wires to the jack. In the first position the circuit board electrically connects at least the third, fourth, fifth, and sixth contact springs to the third, fourth, fifth, and sixth wire termination contacts via a first circuit, and in the second position the circuit board electrically connects ninth, tenth, eleventh, and twelfth contact springs to the third, fourth, fifth, and sixth wire termination contacts via a second circuit on the circuit board different from the first circuit.

In a fifth aspect, a telecommunications jack adapted to receive a plug includes a housing defining a port for receiving the plug, and first, second, third, fourth, fifth, sixth, seventh and eighth consecutively arranged contact springs adapted to make electrical contact with the plug when the plug is inserted into the port of the housing along a first axis. The jack further includes first, second, third, fourth, fifth, sixth, seventh and eighth wire termination contacts for terminating wires to the jack, and a circuit board having a plurality of contact pads, the plurality of contact pads in electrical contact with corresponding first, second, third, fourth, fifth, sixth, seventh and eighth consecutively arranged contact springs. The jack also includes an insulating layer movable between first and second positions, wherein in a first position, the insulating layer is disposed between one or more of the contact springs and corresponding contact pads, and wherein in a second position, the insulating layer is removed from between the one or more contact springs and the corresponding contact pads.

In a sixth aspect, a telecommunications jack adapted to receive a plug includes a housing defining a port sized to receive plugs having at least first and second shapes, the first shape corresponding to an RJ-45 plug and the second shape corresponding to a modified plug, the modified plug having a shape different from a shape of the RJ-45 plug. The jack includes first, second, third, fourth, fifth, sixth, seventh and eighth consecutively arranged contact springs adapted to make electrical contact with the RJ-45 plug when the RJ-45 plug is inserted into the port of the housing along a first axis. The jack further includes first, second, third, fourth, fifth, sixth, seventh and eighth wire termination contacts for terminating wires to the jack, and a circuit board having a plurality of contact pads, the plurality of contact pads in electrical contact with corresponding first, second, third, fourth, fifth, sixth, seventh and eighth consecutively arranged contact springs. The jack also includes an engagement arrangement including an engagement surface positioned to be displaced by a plug having a first shape when inserted into the port, but remain in place when the plug having the second shape is inserted into the port, wherein the engagement arrangement includes a mechanical linkage between a first engagement component including the engagement surface and a second engagement component attached to a circuit component movable between first and second positions, the circuit component biased toward the first position and moved to the second position upon insertion of the modified plug.

DETAILED DESCRIPTION

Figure 1:
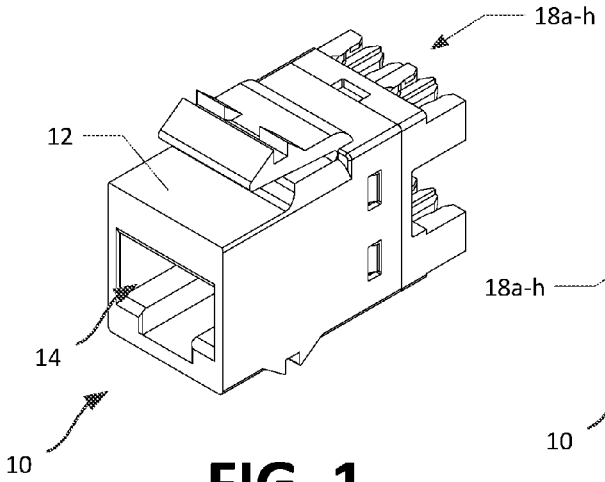
FIG. 1 is a top front perspective view of a telecommunications jack in which aspects of the present disclosure are implemented.
Figure 2:
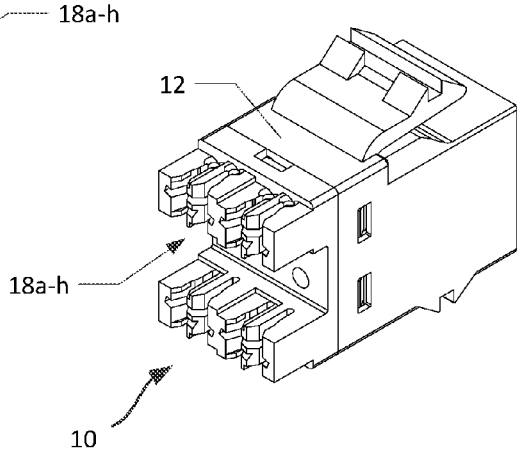
FIG. 2 is a top rear perspective view of the telecommunications jack of FIG. 1.
Figure 3:
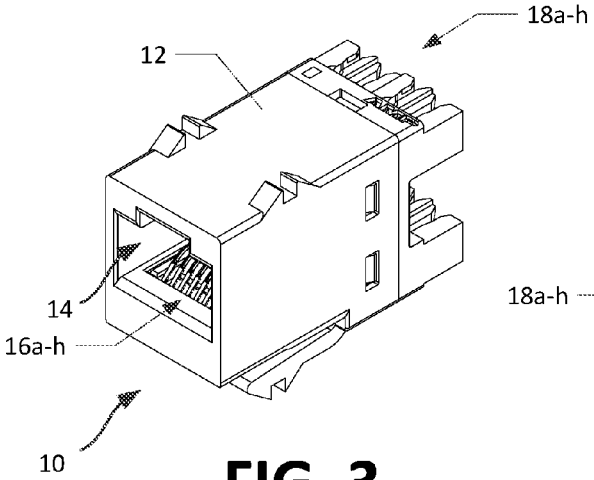
FIG. 3 is a bottom front perspective view of the telecommunications jack of FIG. 1.
Figure 4:
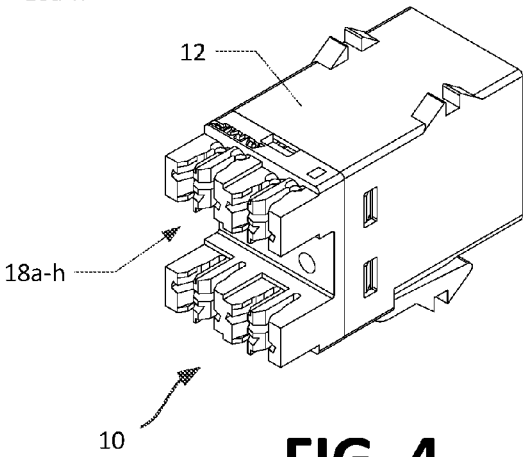
FIG. 4 is a bottom rear perspective view of the telecommunications jack of FIG. 1.
Figure 5:
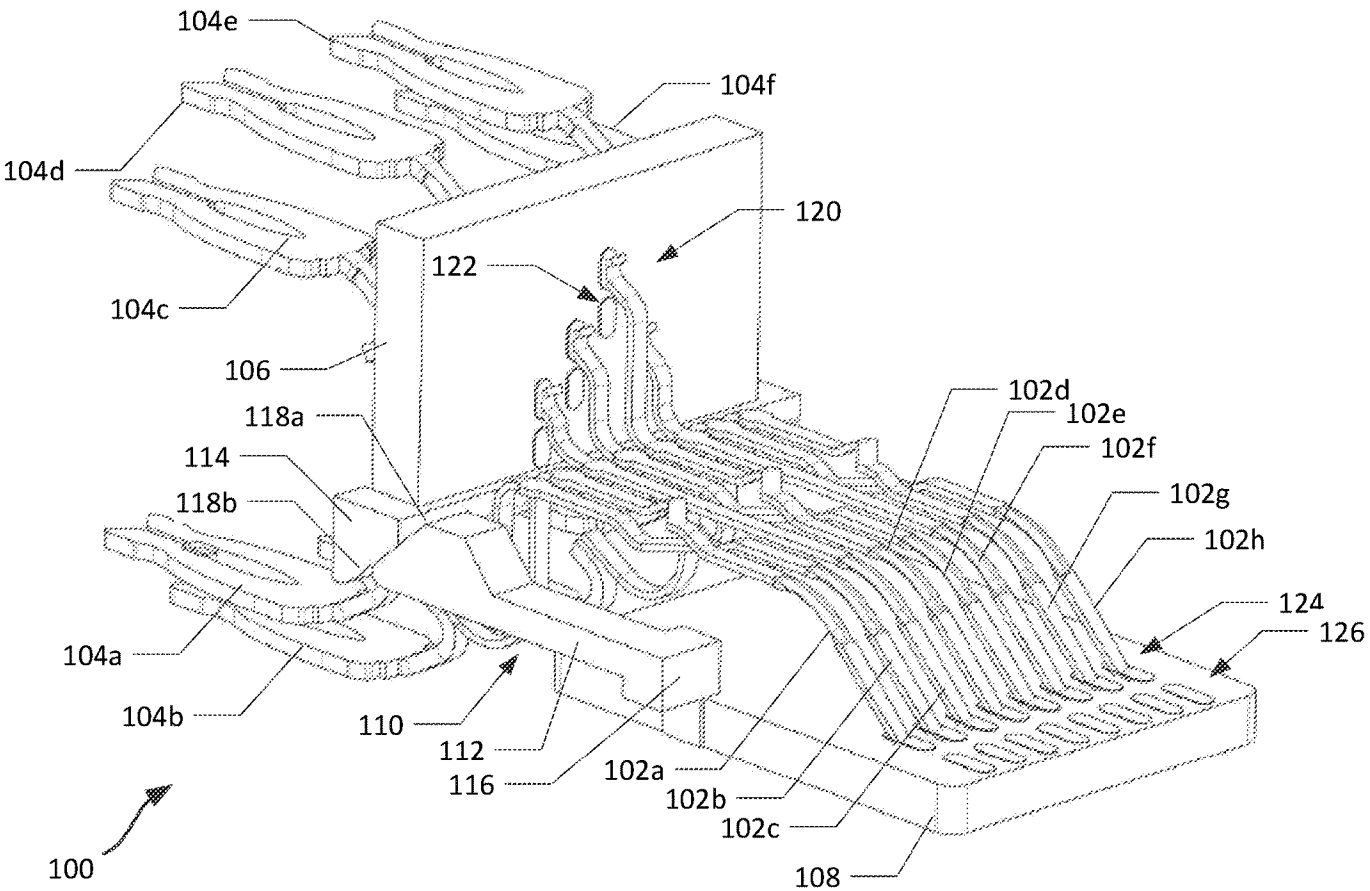
FIG. 5 is a perspective view of a telecommunications jack assembly useable within a telecommunications jack such as the one shown in FIG. 1.
Figure 6:
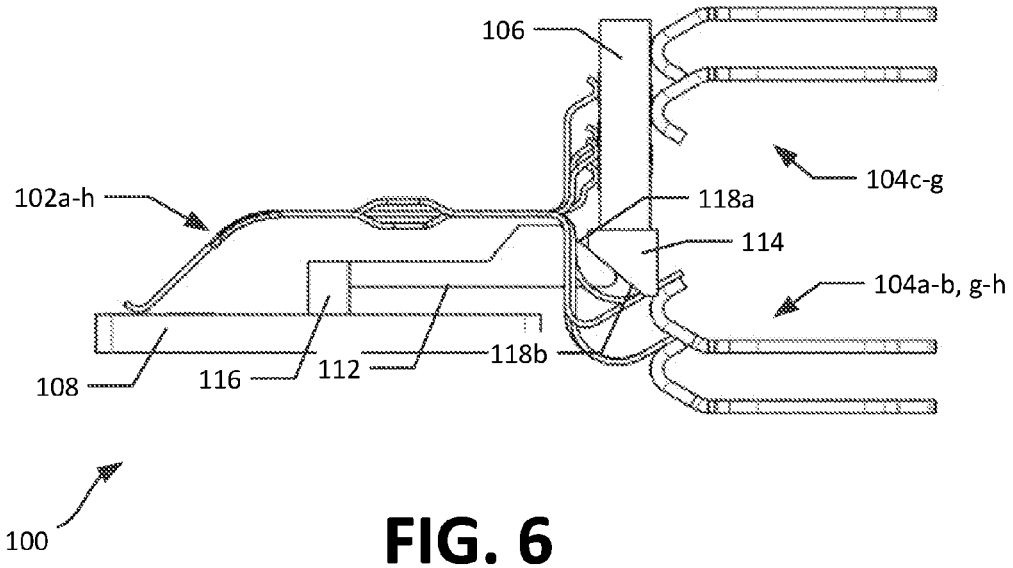
FIG. 6 is a right side plan view of the telecommunications jack assembly of FIG. 5.
Figure 7:
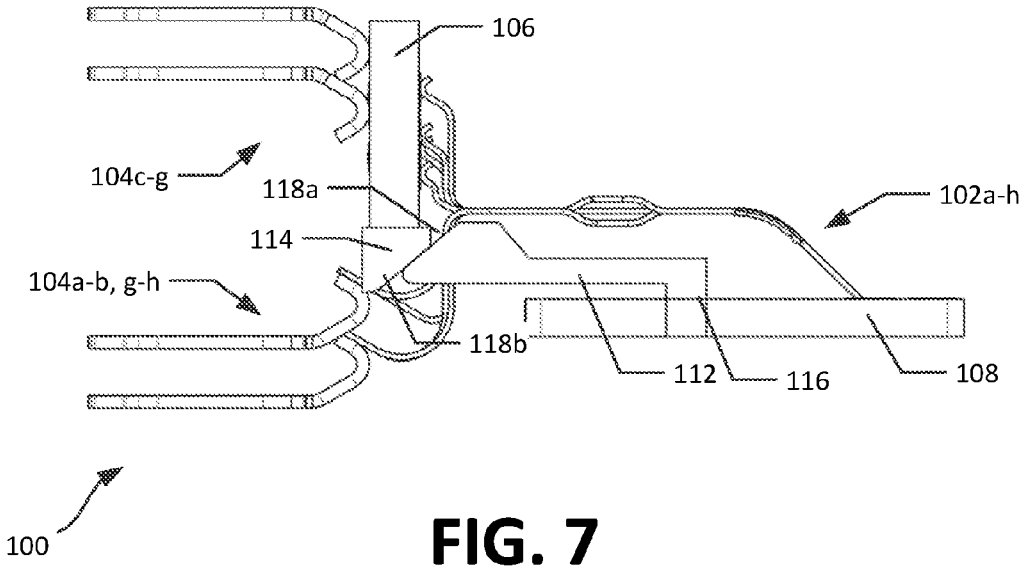
FIG. 7 is a left side plan view of the telecommunications jack assembly of FIG. 5.
Figure 8:
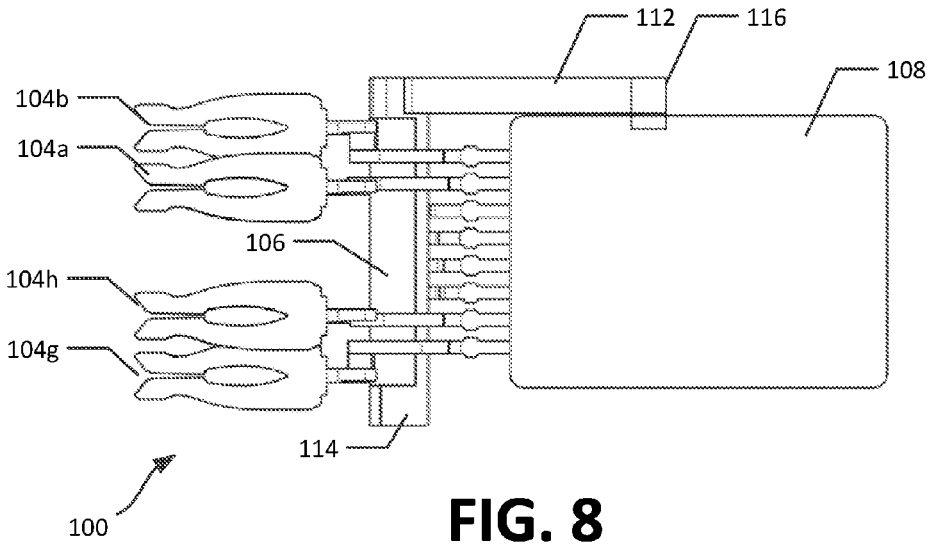
FIG. 8 is a bottom plan view of the telecommunications jack assembly of FIG. 5.
Figure 9:
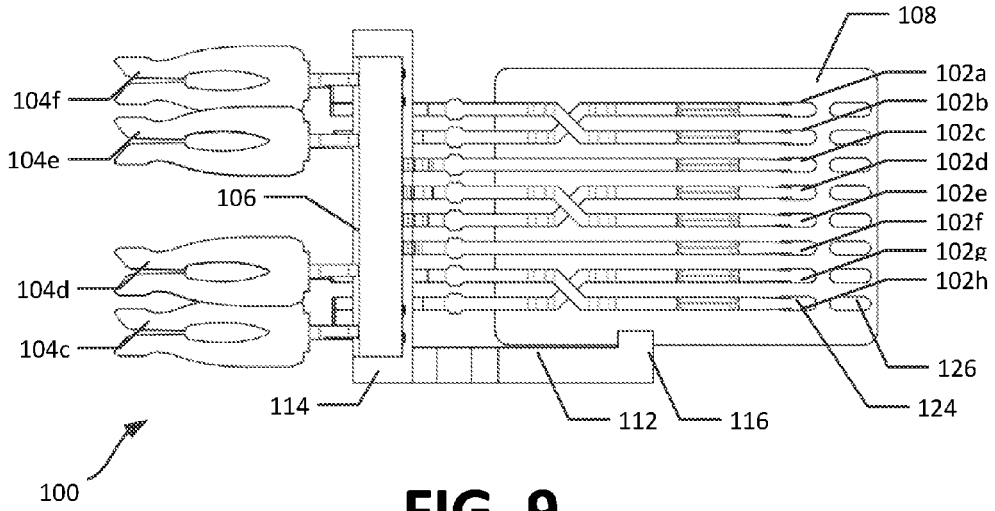
FIG. 9 is a top plan view of the telecommunications jack assembly of FIG. 5.
Figure 10:
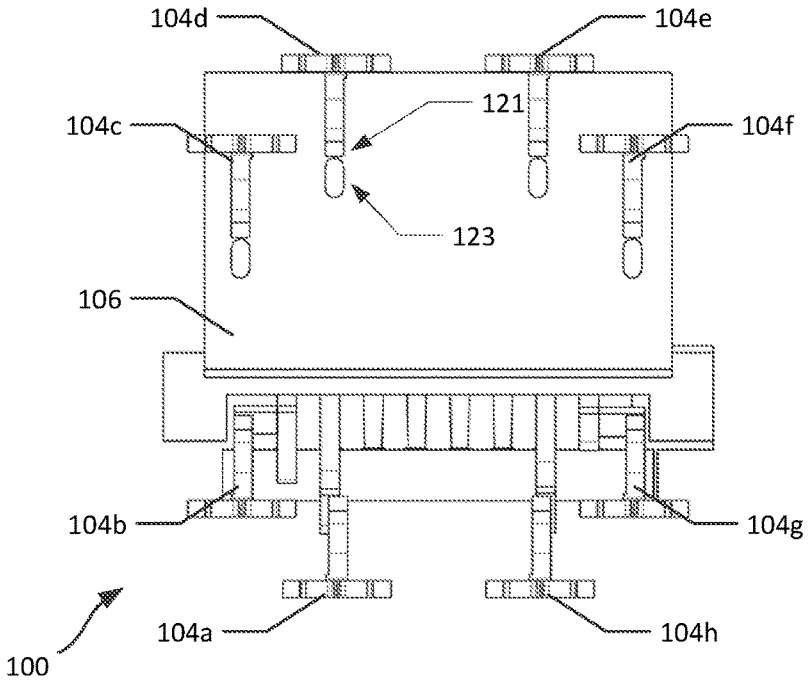
FIG. 10 is a rear plan view of the telecommunications jack assembly of FIG. 5.
Figure 11:
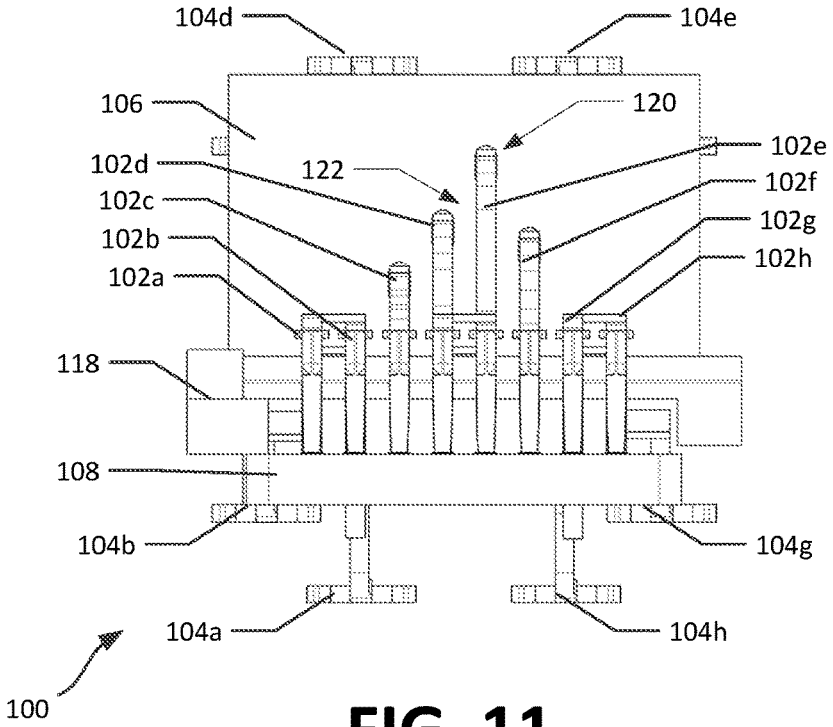
FIG. 11 is a front plan view of the telecommunications jack assembly of FIG. 5.
Figure 12:
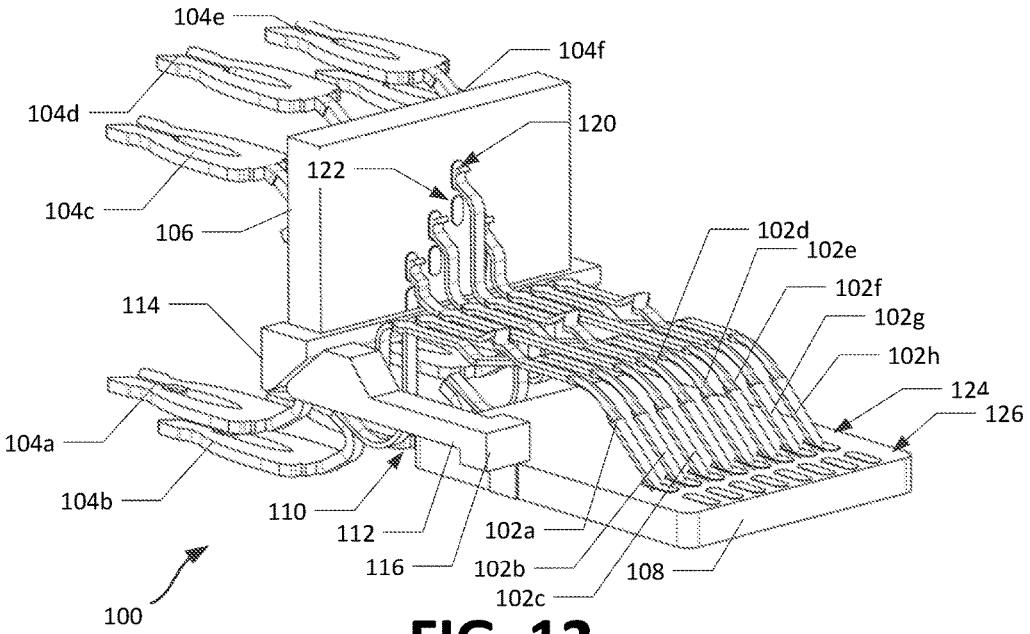
FIG. 12 is a perspective view of the telecommunications jack assembly of FIG. 5 in a first position.
Figure 13:
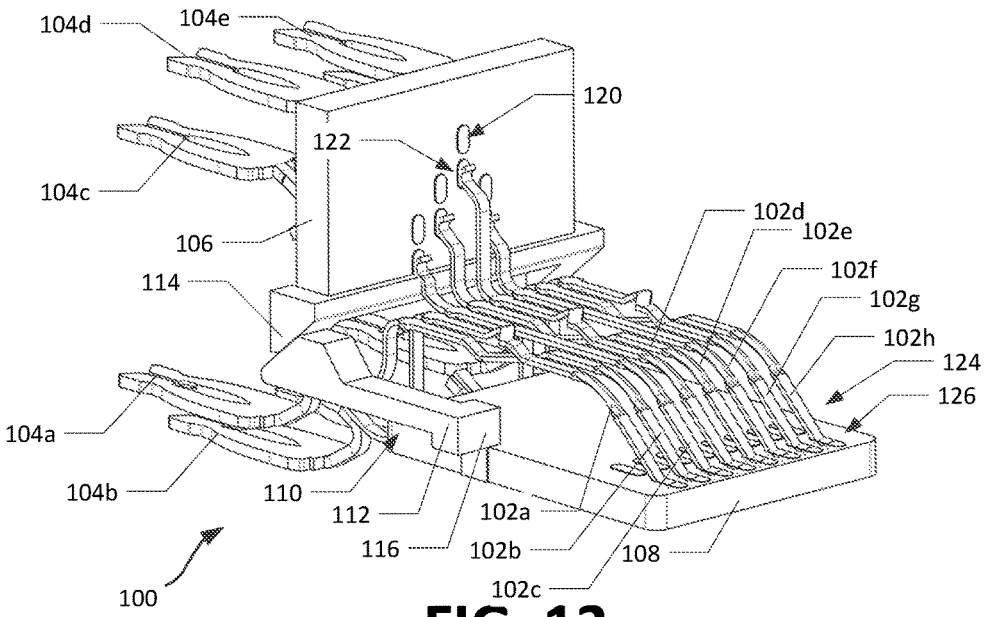
FIG. 13 is a perspective view of the telecommunications jack assembly of FIG. 5, moved to a second position from the first position.
Figure 14:
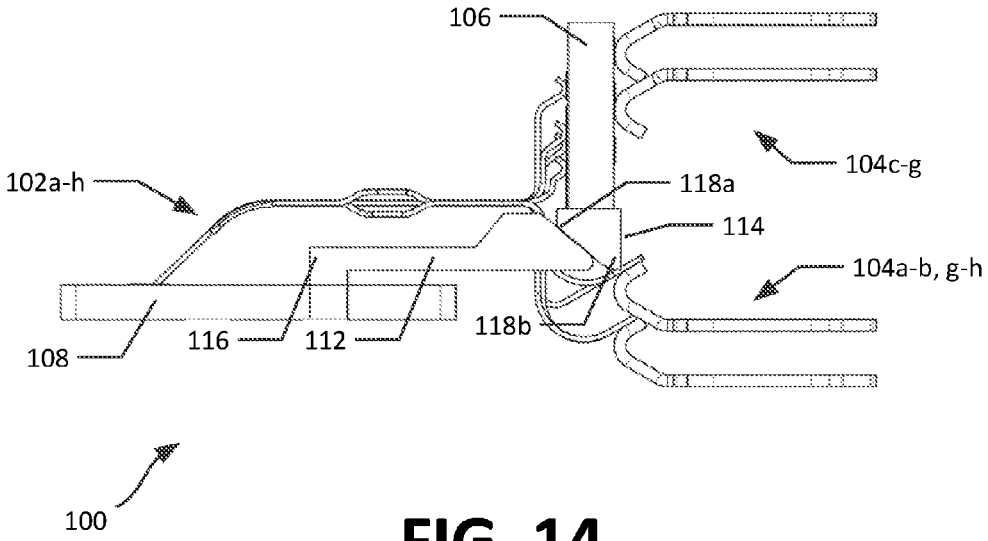
FIG. 14 is a side plan view of the telecommunications jack assembly of FIG. 5 in a first position.
Figure 15:
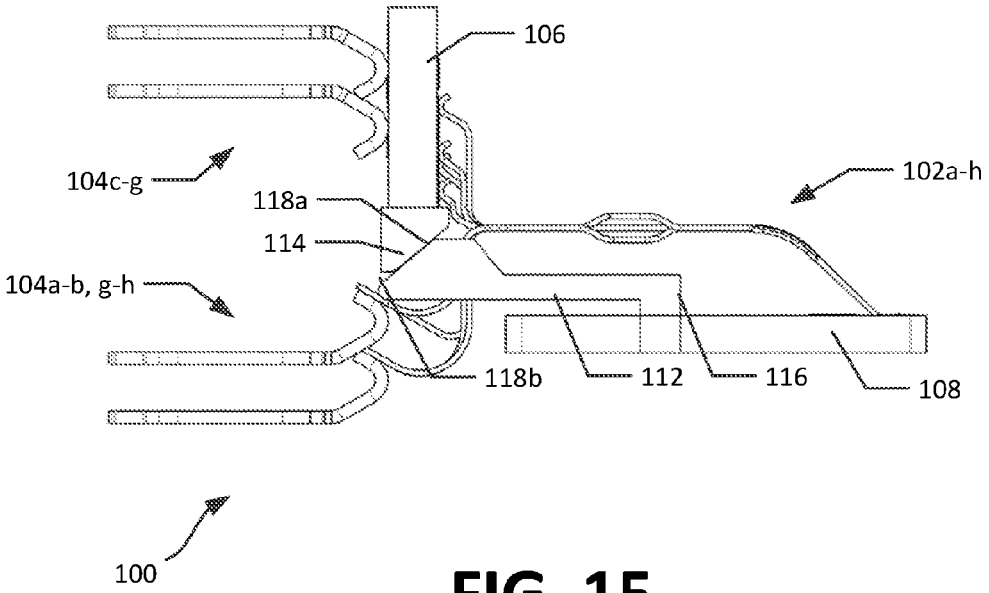
FIG. 15 is a side plan view of the telecommunications jack assembly of FIG. 5, moved to a second position from the first position.
Figure 16:
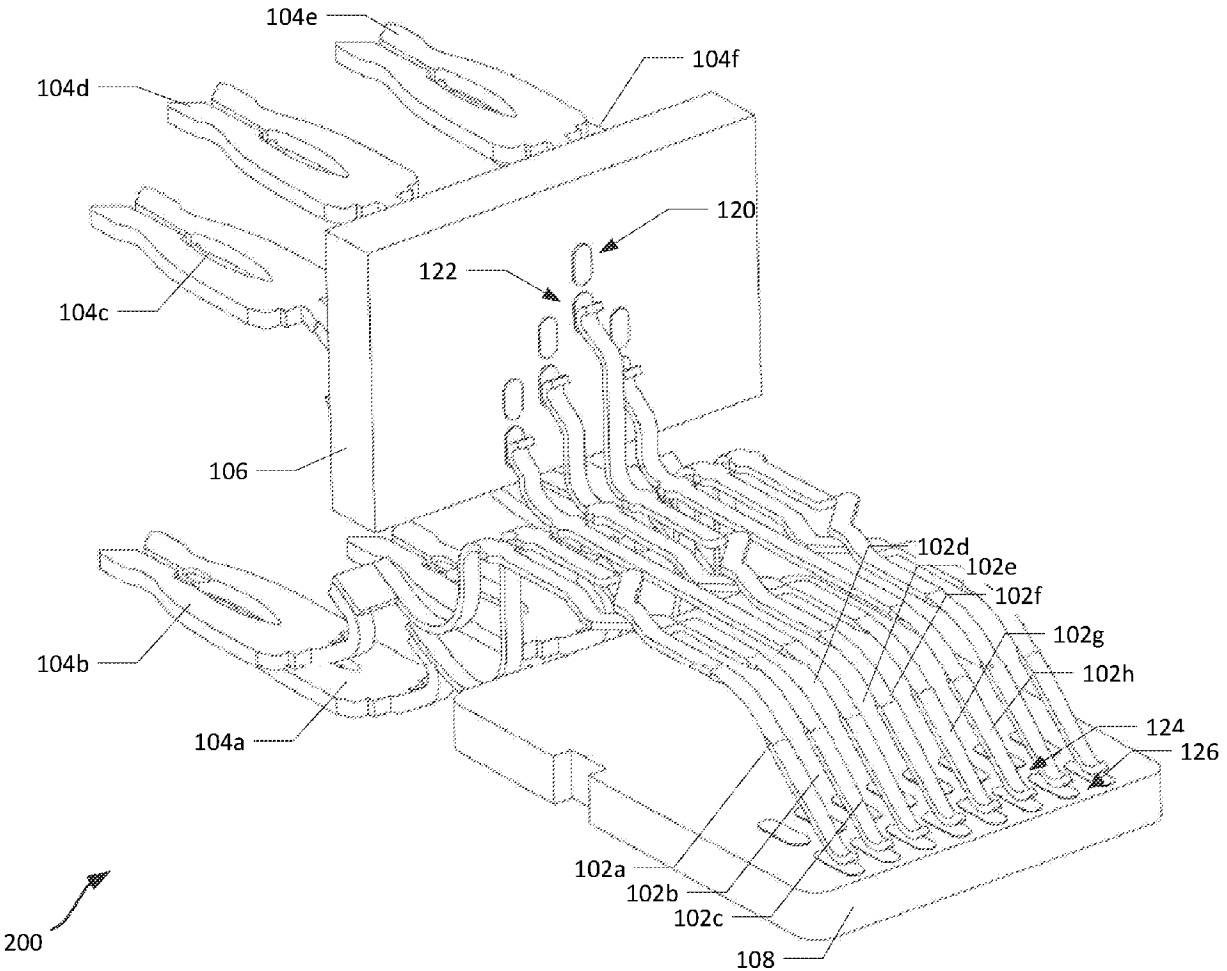
FIG. 16 is a perspective view of a telecommunications jack assembly useable within a telecommunications jack such as the one shown in FIG. 1, positioned in a first position.
Figure 17:
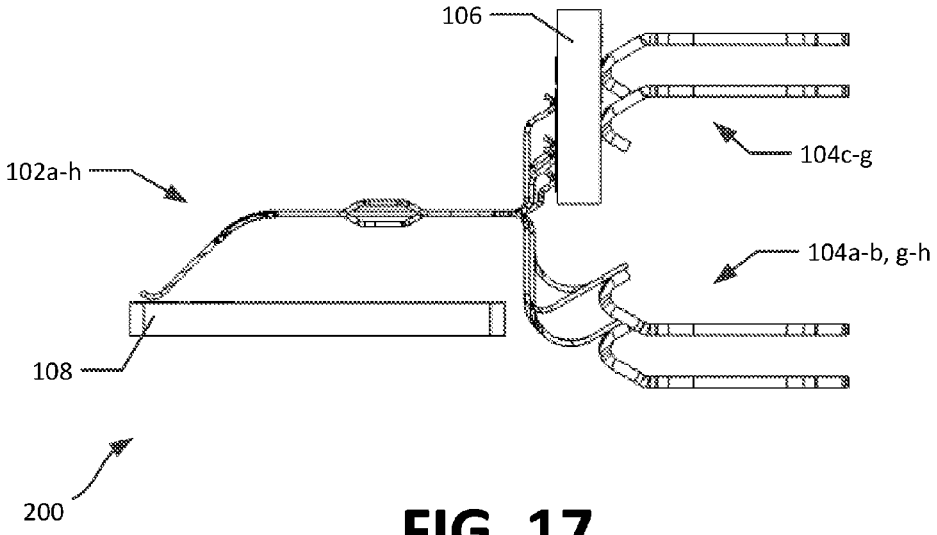
FIG. 17 is a right side plan view of the telecommunications jack assembly of FIG. 16.
Figure 18:
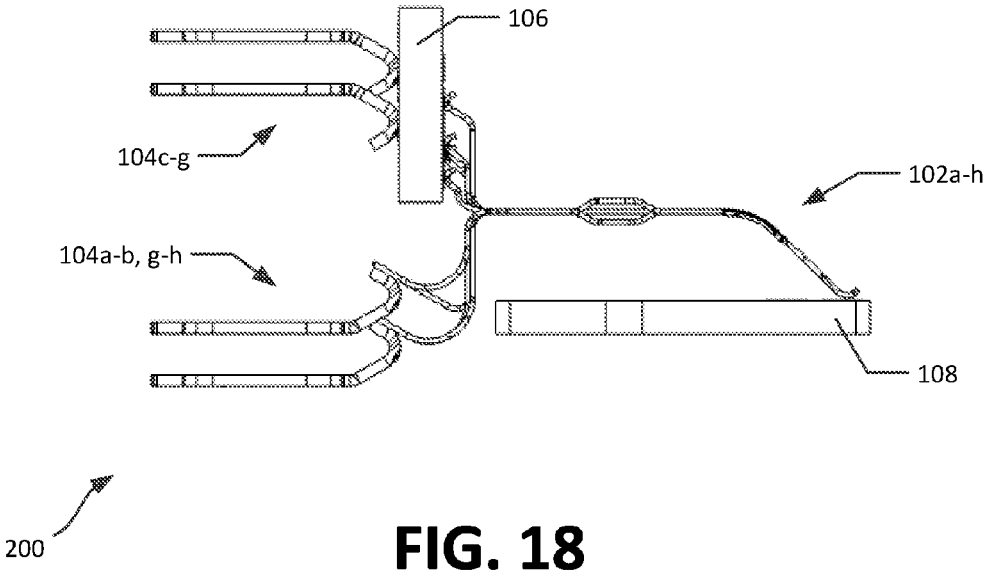
FIG. 18 is a left side plan view of the telecommunications jack assembly of FIG. 16.
Figure 19:
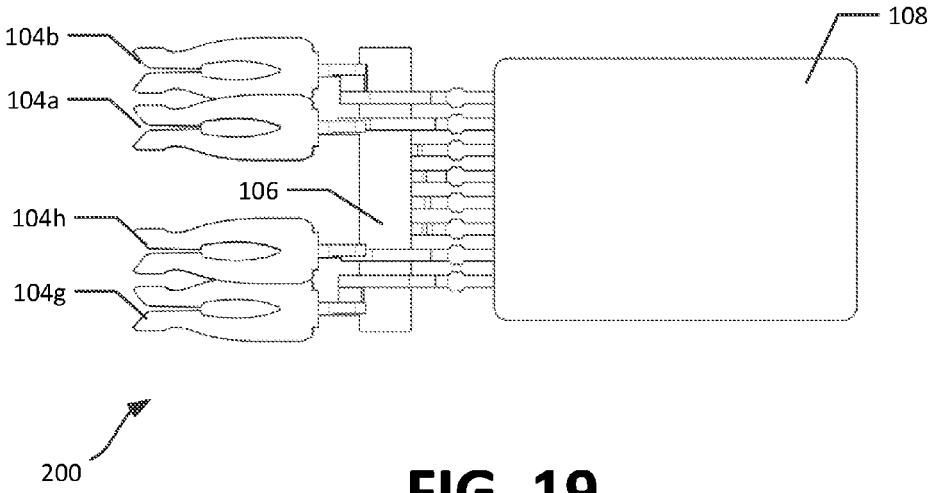
FIG. 19 is a bottom plan view of the telecommunications jack assembly of FIG. 16.
Figure 20:
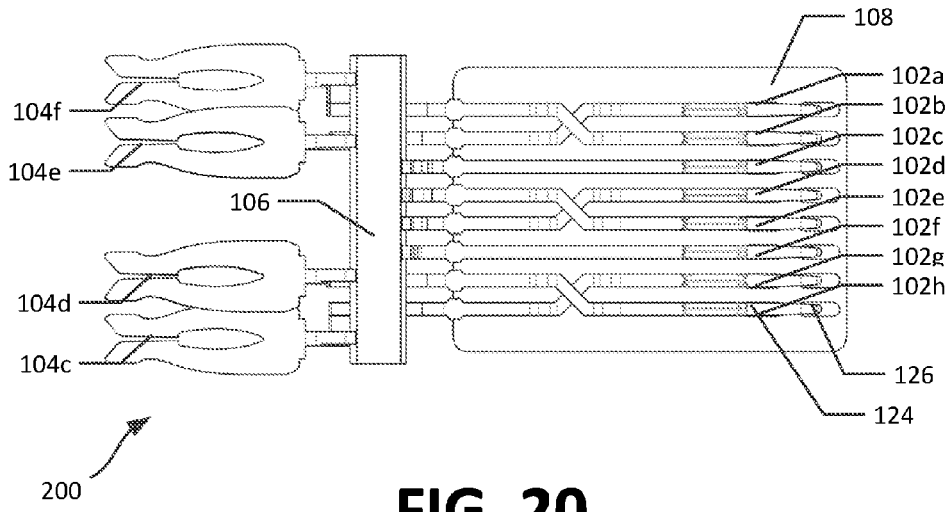
FIG. 20 is a top plan view of the telecommunications jack assembly of FIG. 16.
Figure 21:
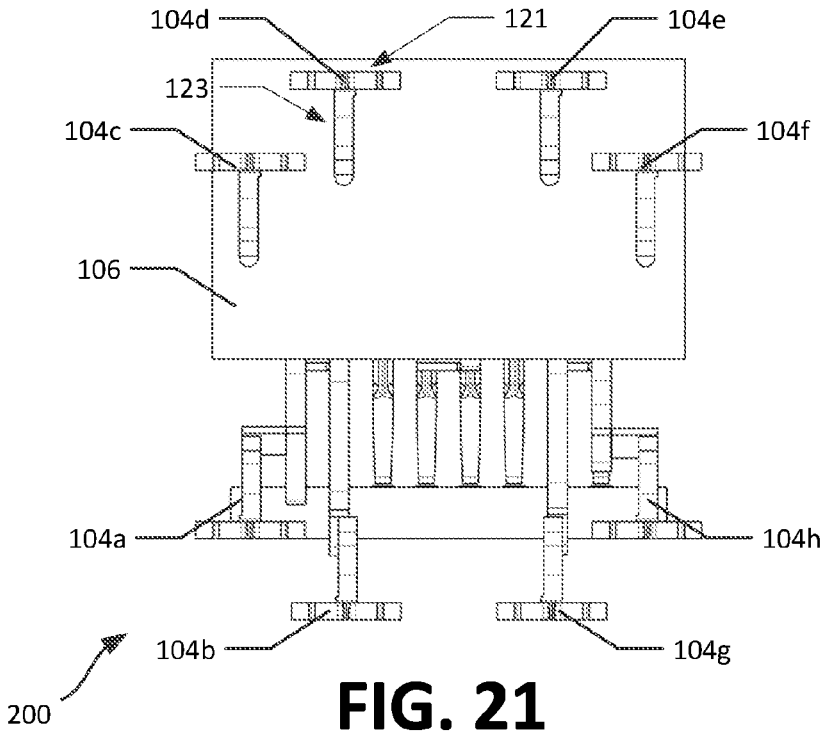
FIG. 21 is a rear plan view of the telecommunications jack assembly of FIG. 16.
Figure 22:
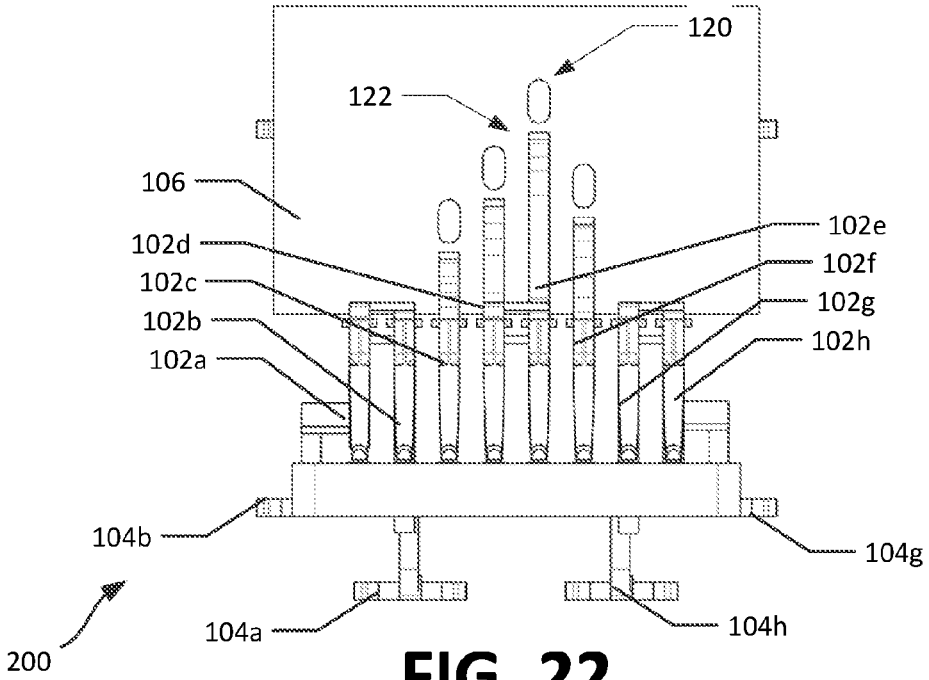
FIG. 22 is a front plan view of the telecommunications jack assembly of FIG. 16.
Figure 23:
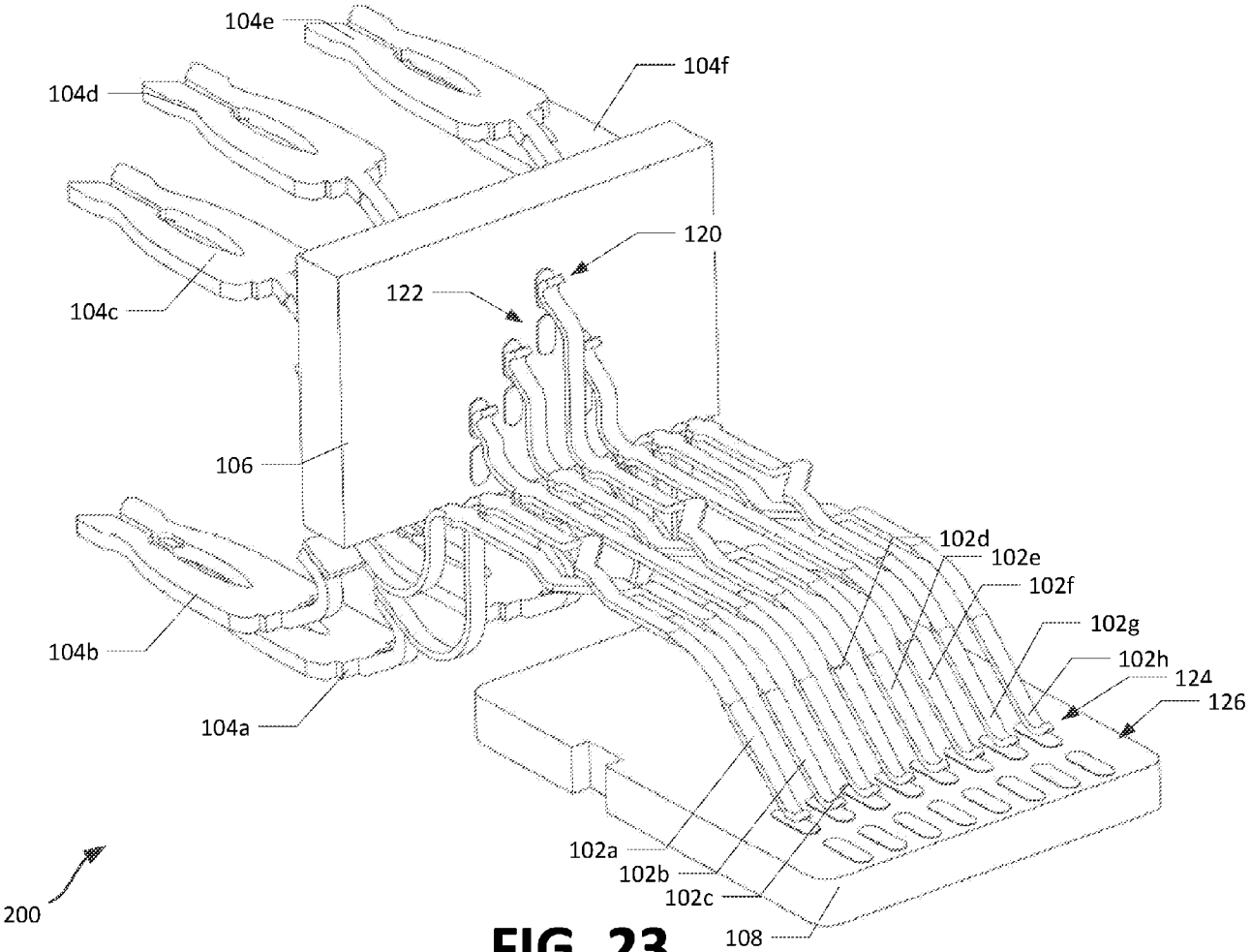
FIG. 23 is a perspective view of the telecommunications jack assembly of FIG. 16, moved from the first position to a second position.
Figure 24:
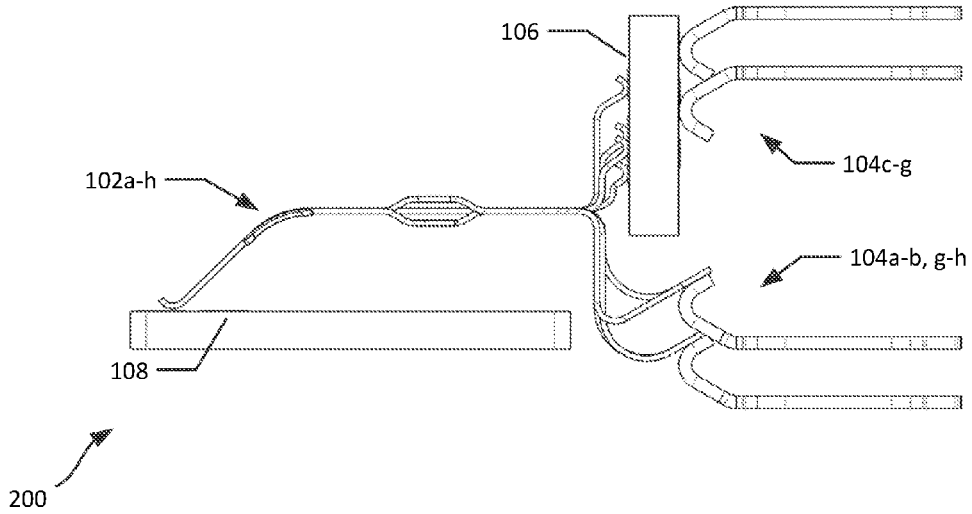
FIG. 24 is a right side plan view of the telecommunications jack assembly of FIG. 23.
Figure 25:
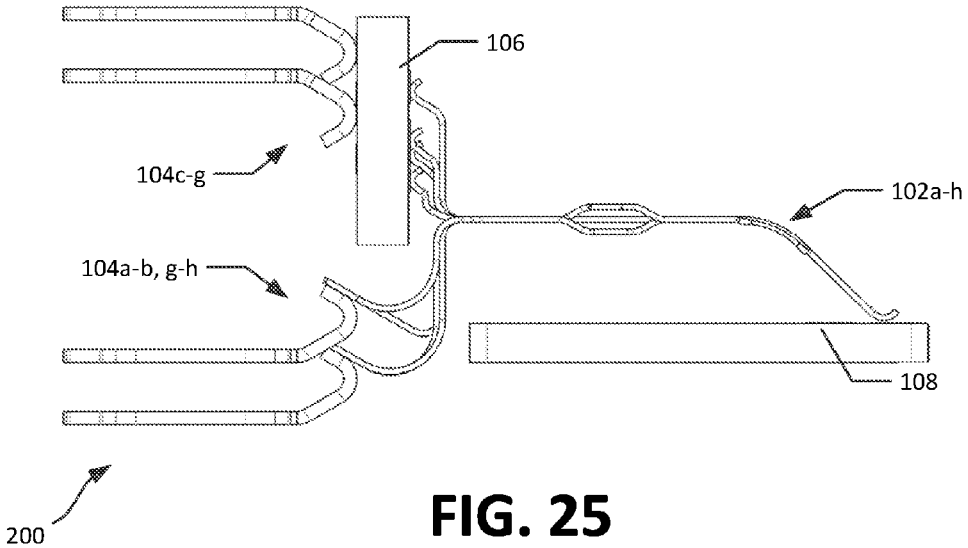
FIG. 25 is a left side plan view of the telecommunications jack assembly of FIG. 23.
Figure 26:
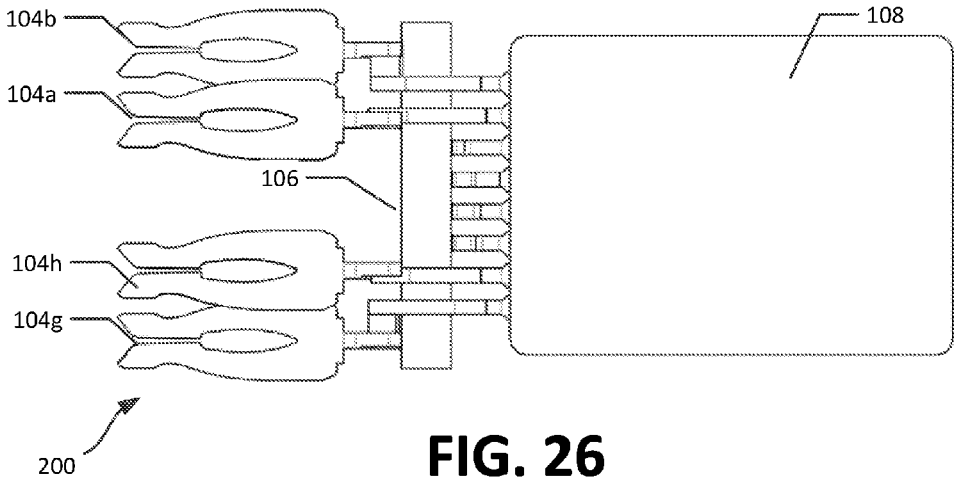
FIG. 26 is a bottom plan view of the telecommunications jack assembly of FIG. 23.
Figure 27:
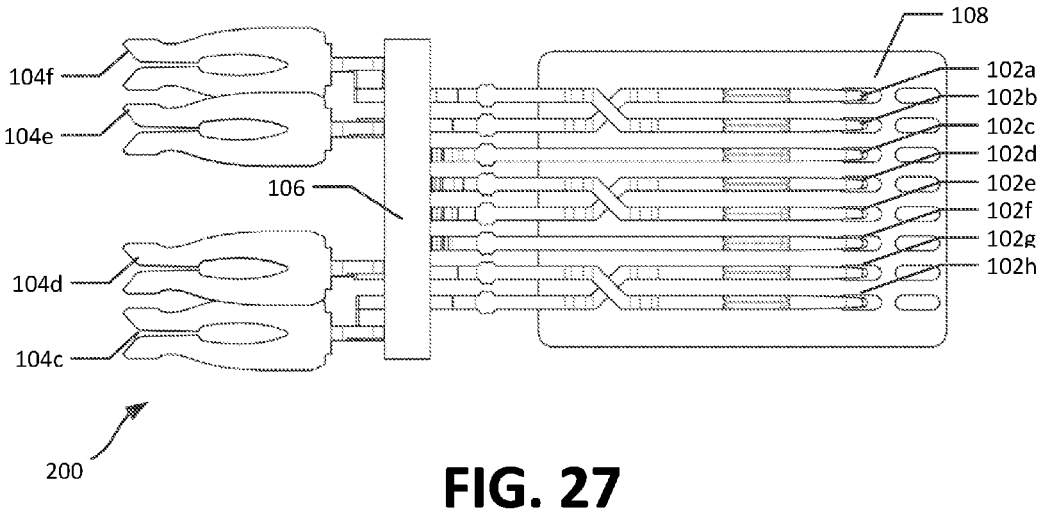
FIG. 27 is a top plan view of the telecommunications jack assembly of FIG. 23.
Figure 28:
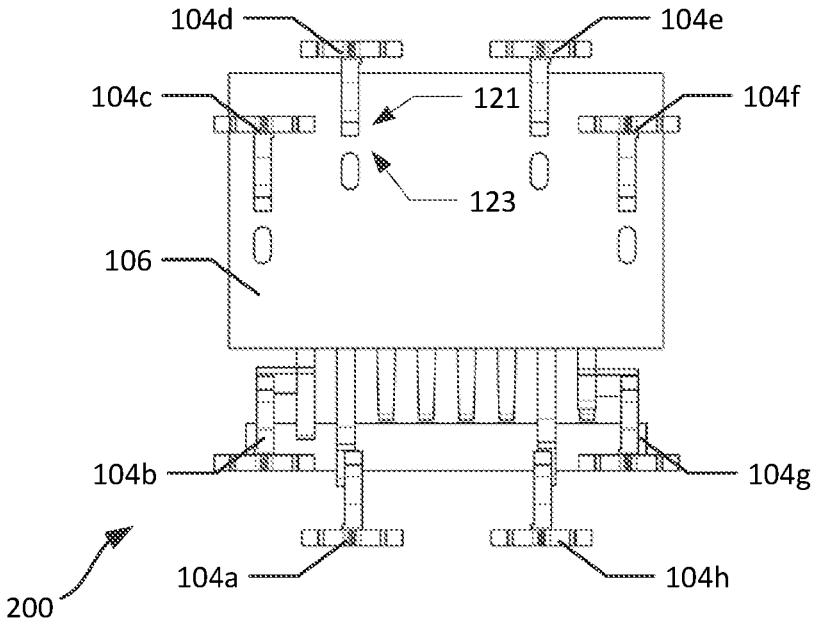
FIG. 28 is a rear plan view of the telecommunications jack assembly of FIG. 23.
Figure 29:
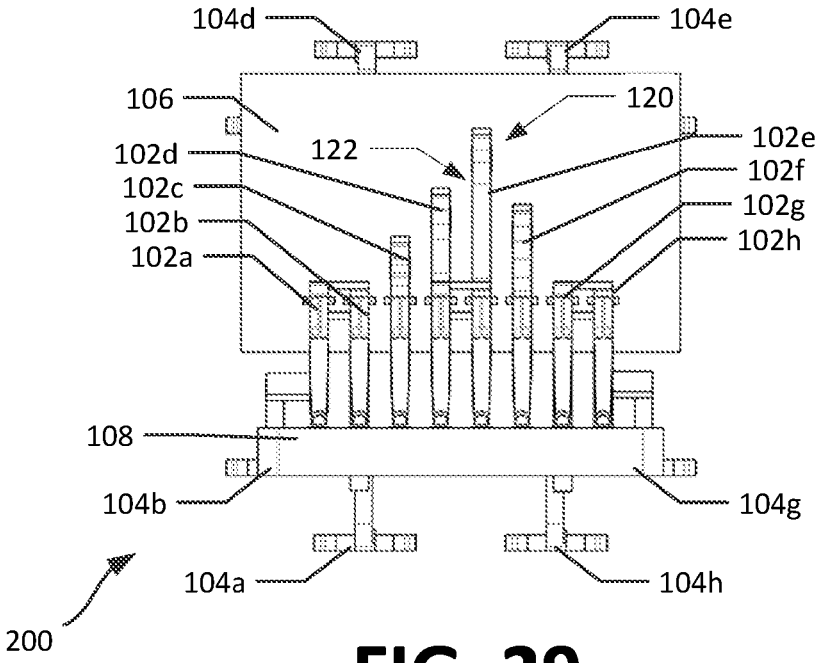
FIG. 29 is a front plan view of the telecommunications jack assembly of FIG. 23.
Figure 30:
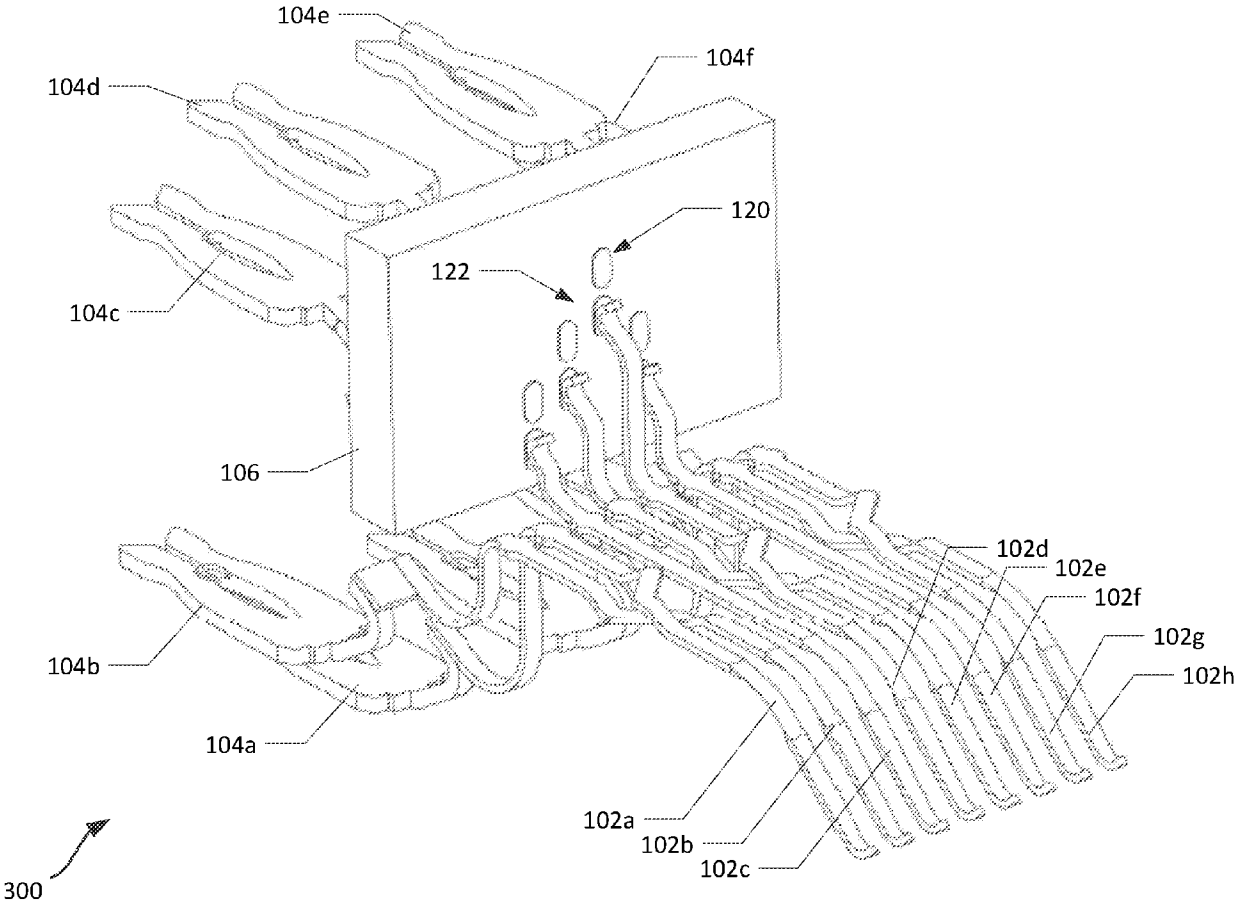
FIG. 30 is a perspective view of a telecommunications jack assembly having a single circuit board, useable within a telecommunications jack such as the one shown in FIG. 1, and positioned in a first position.
Figure 31:
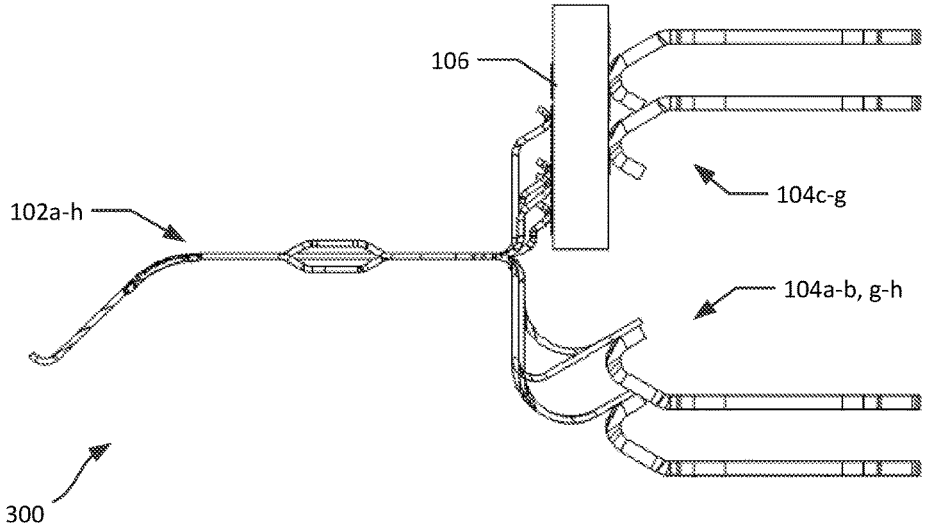
FIG. 31 is a right side plan view of the telecommunications jack assembly of FIG. 30.
Figure 32:
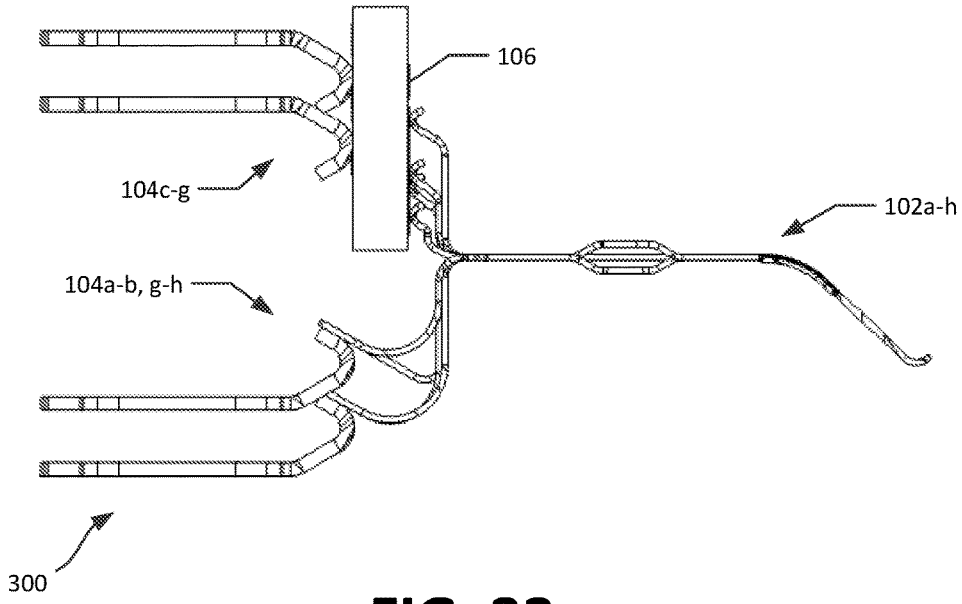
FIG. 32 is a left side plan view of the telecommunications jack assembly of FIG. 30.
Figure 33:
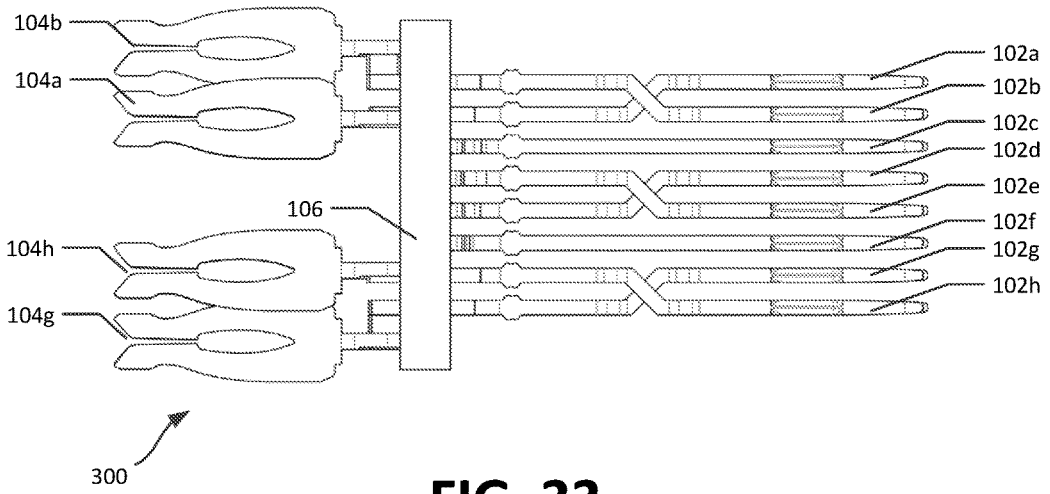
FIG. 33 is a bottom plan view of the telecommunications jack assembly of FIG. 30.
Figure 34:
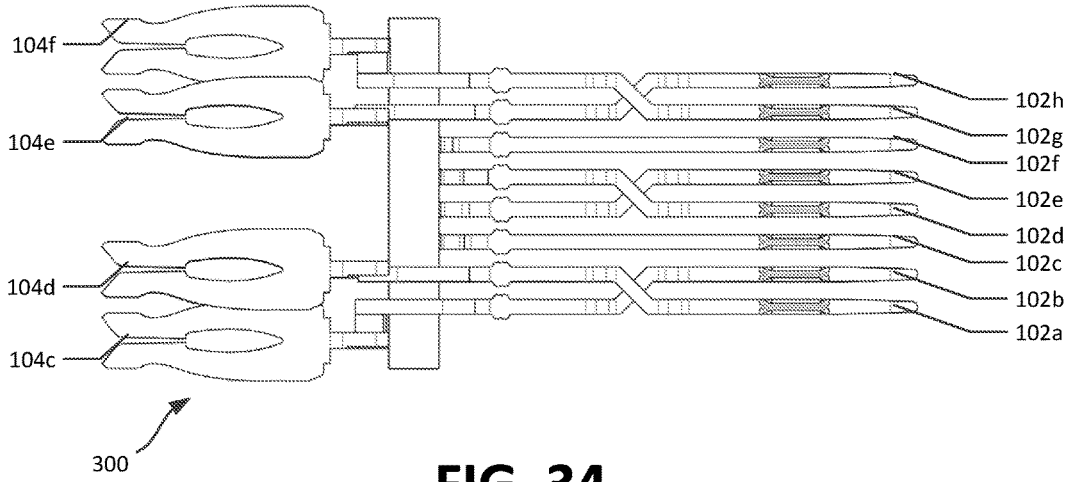
FIG. 34 is a top plan view of the telecommunications jack assembly of FIG. 30.
Figure 35:
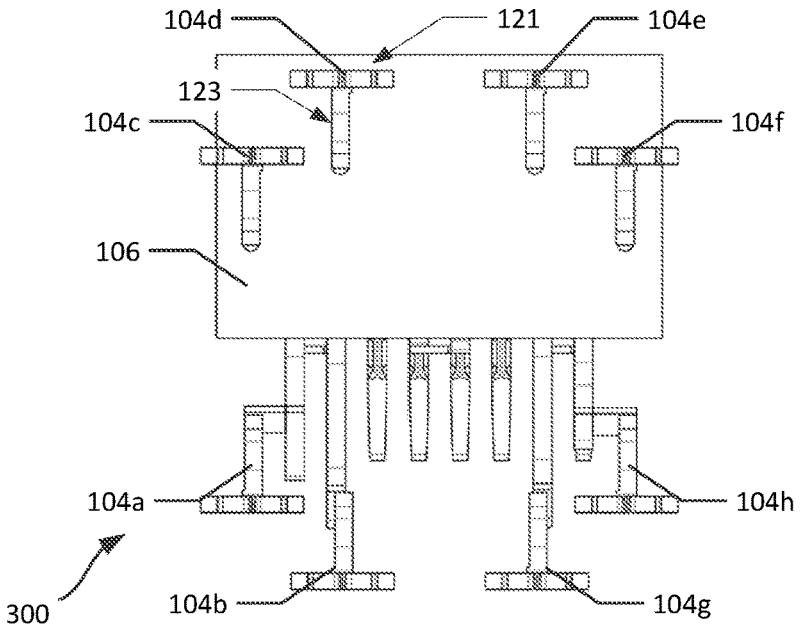
FIG. 35 is a rear plan view of the telecommunications jack assembly of FIG. 30.
Figure 36:
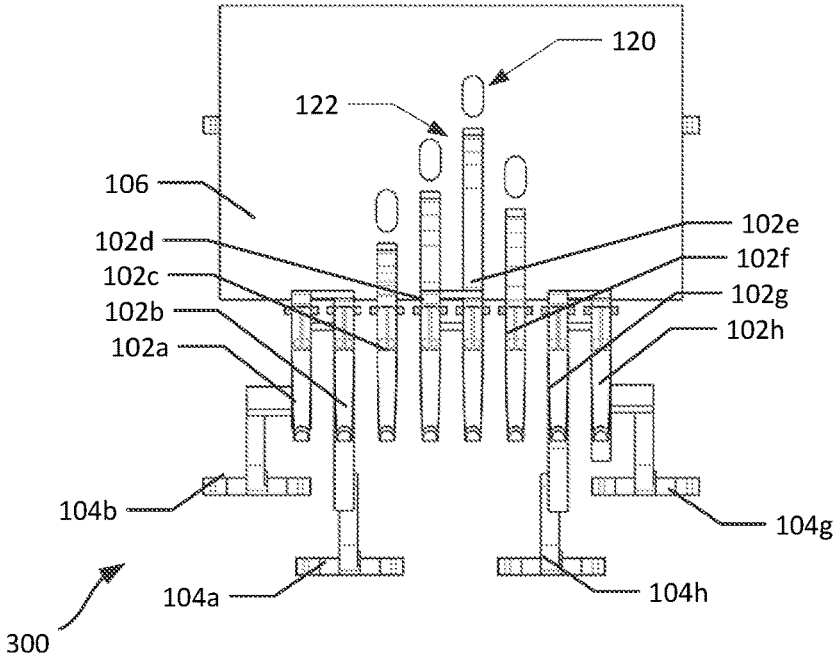
FIG. 36 is a front plan view of the telecommunications jack assembly of FIG. 30.

Various embodiments of the present invention will be described in detail with reference to the drawings, wherein like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In general the present disclosure relates to a telecommunications jack, and in particular a jack that can be used in a telecommunications system that supports operation over a wide range of frequencies including frequencies up to an exceeding 500 MHz. The jack disclosed herein has one or more movable circuit boards allowing for switching between different circuits positioned between contact springs and wire termination contacts. The different circuits can, in various embodiments, have different wire routing configurations and/or different crosstalk compensation circuits, thereby allowing for compatibility with different types of telecommunication networks operable over this wider range of frequencies.

Referring to FIGS. 1-4, a telecommunications jack 10 is disclosed in which aspects of the present disclosure can be implemented. The telecommunications jack 10 includes a housing 12 that defines a port 14 for receiving a plug. The port 14 can be sized to receive a plug having a known format; in various embodiments discussed herein, the plug can correspond to either an RJ-45 or IEC 60603-7-7-compliant plug, each of which are known in the art.

Within the port 14, a plurality of contact springs 16 are disposed to make electrical contact with the plug when inserted along a first axis, defined by a direction of insertion of a plug into the port 14. In the case of an RJ-45 plug and compatible jack, the telecommunications jack 10 includes a set of eight consecutively-arranged contact springs 16*a-h*. Examples of positioning of contact springs for use with an RJ-45 plug are illustrated in FIGS. 5-38, discussed below. In the case of a IEC 60603-7-7-compliant plug and compatible jack, four additional contact springs can be included on an opposite side of a port 14, for connection to wires exposed on an opposite side of the plug. Examples of positioning of IEC 60603-7-7-compliant contact springs are illustrated in FIGS. 39-54, discussed below.

In the embodiment shown, the telecommunications jack 10 includes a plurality of wire termination contacts, shown as insulation displacement contacts 18*a-h*. In alternative embodiments, rather than insulation displacement contacts, other types of termination contacts, such as posts for electrical connection to wires or bonding to a circuit board, could be used. Furthermore, although the insulation displacement contacts 18*a-h* are shown as positioned on a surface opposite from the port 14, in alternative embodiments, the insulation displacement contacts or other wire termination contacts could be exposed from a different surface of the housing, e.g., from the bottom of the housing.

As more fully discussed below, the telecommunications jack 10 is configured to retain one or more circuit boards useable in connection with telecommunications circuits that implement different communications standards, and accordingly different signal frequencies. In particular, the telecommunications jack 10 is sized to support one or more movable circuit boards, and includes a mechanism for allowing an RJ-45 or IEC 60603-7-7-compliant plug to engage with a feature within the port 14 to move the circuit board or boards between at least first and second positions to cause electrical connection of different circuits between the contact springs 16 and wire termination contacts, e.g., insulation displacement contacts 18. For example, in a first position, a circuit providing a wiring configuration and associated crosstalk compensation scheme for use in connection with signal frequencies of 1-500 MHz is provided, and in a second position, a different circuit providing a wiring configuration and associated crosstalk compensation scheme for use in connection with signal frequencies in excess of 500 MHz is provided.

Referring now to FIGS. 5-11, an example of a telecommunications jack assembly 100 is shown that can be used within the telecommunications jack 10 of FIGS. 1-4. The telecommunications jack assembly 100 includes a plurality of consecutively arranged contact springs, including first, second, third, fourth, fifth, sixth, seventh, and eighth contact springs 102*a-h*, respectively. The telecommunications jack assembly 100 also includes a corresponding plurality of insulation displacement connectors, including first, second, third, fourth, fifth, sixth, seventh, and eighth insulation displacement connectors 104*a-h* to which the contact springs 102*a-h* are respectively connected.

In the embodiment shown, the telecommunications jack assembly 100 includes a first circuit board 106 and a second circuit board 108. The first circuit board 106 is electrically connected to third, fourth, fifth, and sixth contact springs 102*c-f*, as well as corresponding third, fourth, fifth, and sixth insulation displacement connectors 104*c-f*. The first, second, seventh, and eighth contact springs 102*a-b*, 102*g-h* are directly connected to corresponding insulation displacement connectors 104*a-b*, 104*g-h*, in a wire frame construction. The second circuit board 108 contacts a lead edge of each of the first, second, third, fourth, fifth, sixth, seventh, and eighth contact springs 102*a-h*.

The telecommunications jack assembly 100 includes an engagement section 110 that includes first and second sections 112, 114, respectively. The first section 112 is mounted in connection with the second circuit board 108, and includes an engagement surface 116 and complementary ramp sections 118*a-b*. The engagement surface 116 is positionable within a port 14 to engage with an specially-shaped plug, for example a plug having an extension thereon along one or both sides of the plug where the engagement surface is located. Although insertion of a standard RJ-45 plug will not displace the engagement surface 116, insertion of a specially-shaped plug will press the engagement surface 116 toward a rear of the plug 10, causing movement of the second circuit board in a direction generally parallel with a direction of insertion of a plug between first and second positions. Additionally, insertion of such a plug will cause a ramp section 118*a* of the first section 112 to engage the second section 118*b*, which is mounted in connection with the first circuit board 106. Movement of the first section 112 rearwardly within the jack housing 12 will cause slidable engagement between ramp sections 118*a-b* moving the first circuit board 106 between first and second positions, generally in a direction non-parallel with an axis defined by the direction of insertion of the plug into port 14.

It is noted that in the context of the embodiments discussed herein, the first and second positions of the first and second circuit boards, respectively, are discussed such that insertion of a standard RJ-45 (or IEC 60603-7-7-compliant) jack results in the circuit boards remaining in place, but insertion of a "modified" plug causes movement from a first position to a second position, via contact with the engagement surface. However, as recognized herein, a modified plug could be provided which has a different geometry from the standard jack size/shape such that insertion of the standard plug would engage the engagement surface 116, while the modified plug would not engage such a surface. Accordingly, the circuit used for compensation when used with a modified plug could be selected by leaving the circuit board in a first position, while switching to a second position for use with standard RJ-45 or IEC 60603-7-7-compliant jacks. Accordingly, as discussed herein, movement between first and second positions, when inserting either a modified or standard plug, are considered to be equivalent operations within the context of the present disclosure, as well as the claims that follow hereto.

In FIGS. 16-22 and 23-29, movement of circuit boards between first and second positions are shown in further detail in connection with a telecommunications jack subassembly 200. The telecommunications jack subassembly 200 generally corresponds to a portion of the telecommunications jack assembly 100 of FIGS. 5-15, but with the engagement section 110 removed for ease of illustration.

In the embodiment shown, the first circuit board 106 has first and second sets of contact pads 120, 122 on a front surface, useable to electrically connect contact springs 102*c-f* to insulation displacement connectors 104*c-f*. The first circuit board 106 also has first and second contact pads 121, 123 on a rear surface, respectively, that electrically connect to insulation displacement connectors 104*c-f*. The second circuit board 108 has first and second sets of contact pads 124, 126, respectively, which are useable to electrically connect to corresponding contact springs 102*a-h*. As seen in FIGS. 5-11, and illustrated in further detail in FIGS. 12-15, the first and second positions of the first circuit board 106 are generally in a direction non-parallel with the direction of insertion of a plug, and can be, such as in the embodiment shown, moved in a direction generally perpendicular with the direction of insertion of a plug. The engaged ramp sections 118*a-b* slidably engage, causing movement of the first circuit board 106 between first and second positions such that, in a first position, contact springs 102*c-f* are electrically connected to first contact pads 120 and insulation displacement connectors 104*c-f* electrically connect to first contact pads 121. In a second position, contact springs 102*c-f* are electrically connected to second contact pads 122, and insulation displacement connectors 104*c-f* electrically connect to second contact pads 123. Similarly, the first and second positions of the second circuit board 108 are generally based on movement of the first section 112 in a direction parallel with the direction of insertion of the plug, and cause movement of the second circuit board 108 such that, in a first position, the contact springs 102*a-h* are in contact with the first set of contact pads 124, and in the second position the contact springs 102*a-h* are in contact with the second set of contact pads 126.

In connection with the present disclosure, it is noted that switching between first and second positions can have a number of different types of effects. Furthermore, first and second circuit boards 106, 108 can have different effects. For example, the first circuit board 106 can be used to reassign contact pairs across the contact springs 102*a-h* and optionally apply different crosstalk compensation arrangements based on the type of plug inserted, and a second circuit board 108 can be used to also apply additional, different crosstalk compensation arrangements based on the type of plug inserted. Reassignment of contact pairs provided on the first circuit board 106 is discussed in further detail in connection with FIGS. 37-38, below. Use of different crosstalk compensation arrangements can take many forms. For example, a first circuit useable on the second circuit board (connected to contact pads 124) can be useable to provide crosstalk compensation for signal frequencies up to about 500 MHz; example crosstalk compensation arrangements are discussed in U.S. Pat. Nos. 7,381,098, 7,402,085, 7,787,615, and 8,151,457, the disclosures of which are hereby incorporated by reference in their entireties. A second circuit useable on the second circuit board (connected to contact pads 126) can be useable o provide crosstalk compensation for signal frequencies in excess of about 500 MHz, using analogous crosstalk compensation principles as discussed in the above-described patents, but with compensation positioned for higher-frequency data signals.

As seen in FIGS. 16-22, subassembly 200 is shown with circuit boards 106, 108 in first positions, respectively. In this arrangement, traditional operation with an RJ-45 connector for signal frequencies of about 1-500 MHz are provided, such as may be presented using Category-6 and below cabling. As seen in FIGS. 23-29, subassembly 200 is shown with circuit boards 106, 108 in second positions, respectively. In this arrangement, the first circuit board 106 has been moved vertically to change between a first circuit and a second circuit on each of the first and second circuit boards 106, 108, for use with signals having frequencies above 500 MHz.

It is noted that in preferred embodiments, the telecommunications jack assembly 100, and subassembly 200, are biased (e.g., spring-biased, gravity-biased, or otherwise defaulted) to be positioned in a first position in the absence of a plug inserted into the jack. In this way, it is ensured that in the absence of a plug having a particular geometrical configuration to contact engagement surface 116, typical RJ-45 jacks will be connected to the contact springs such that routing and/or crosstalk compensation is provided that is compatible with frequencies used in preexisting RJ-45 arrangements, up to about 500 MHz. Of course, as noted above, the effects of positioning the circuit boards 106, 108 in first and second positions can be reversed, with the first (default) position providing compensation for signal frequencies in excess of 500 MHz, and the second position providing compensation for signal frequencies of about 1-500 MHz.

As seen in FIGS. 30-36, it is noted that in some embodiments, an alternative subassembly 300 can be used in the jack 10 and telecommunications assembly 100 of FIGS. 1-14, in which only a single circuit board 106 is used. In this arrangement, no second circuit board is required; in such cases, one or both of pair assignment and crosstalk compensation arrangements can be switched using the single circuit board.

Figure 37:
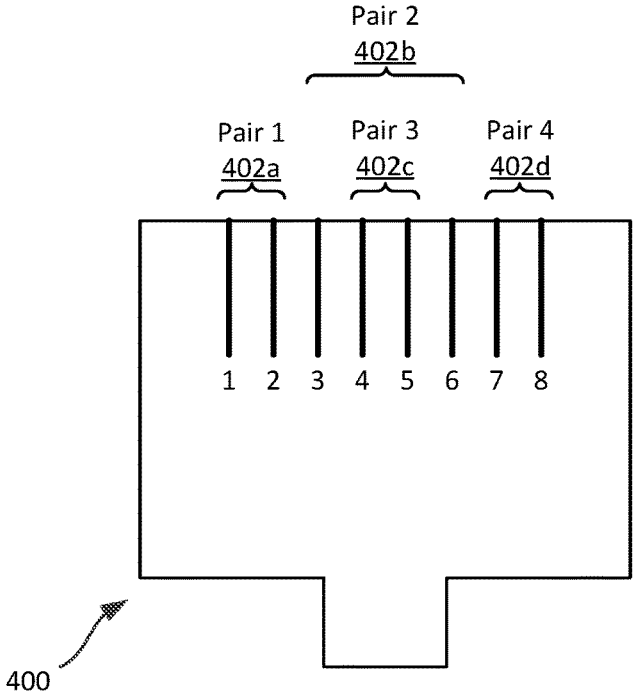
FIG. 37 is a schematic illustration of a pin assignment in a telecommunications jack when a circuit board is located in a first position, according to an example embodiment.
Figure 38:
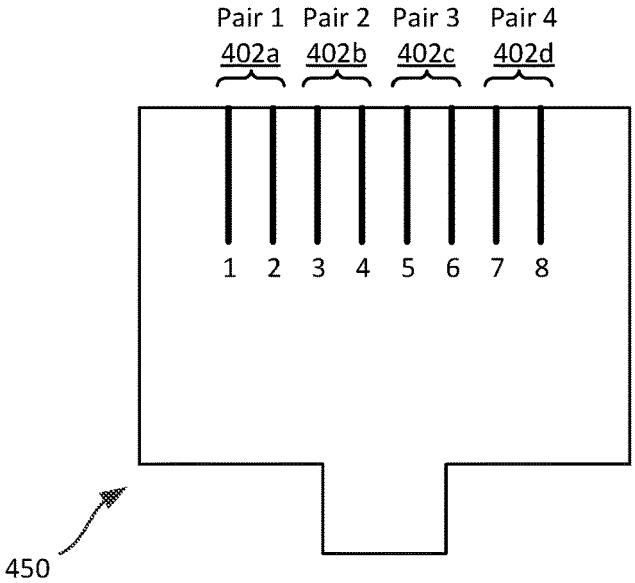
FIG. 38 is a schematic illustration of a pin assignment different from that of FIG. 37, when a circuit board is located in a second position, according to an example embodiment.
Figure 39:
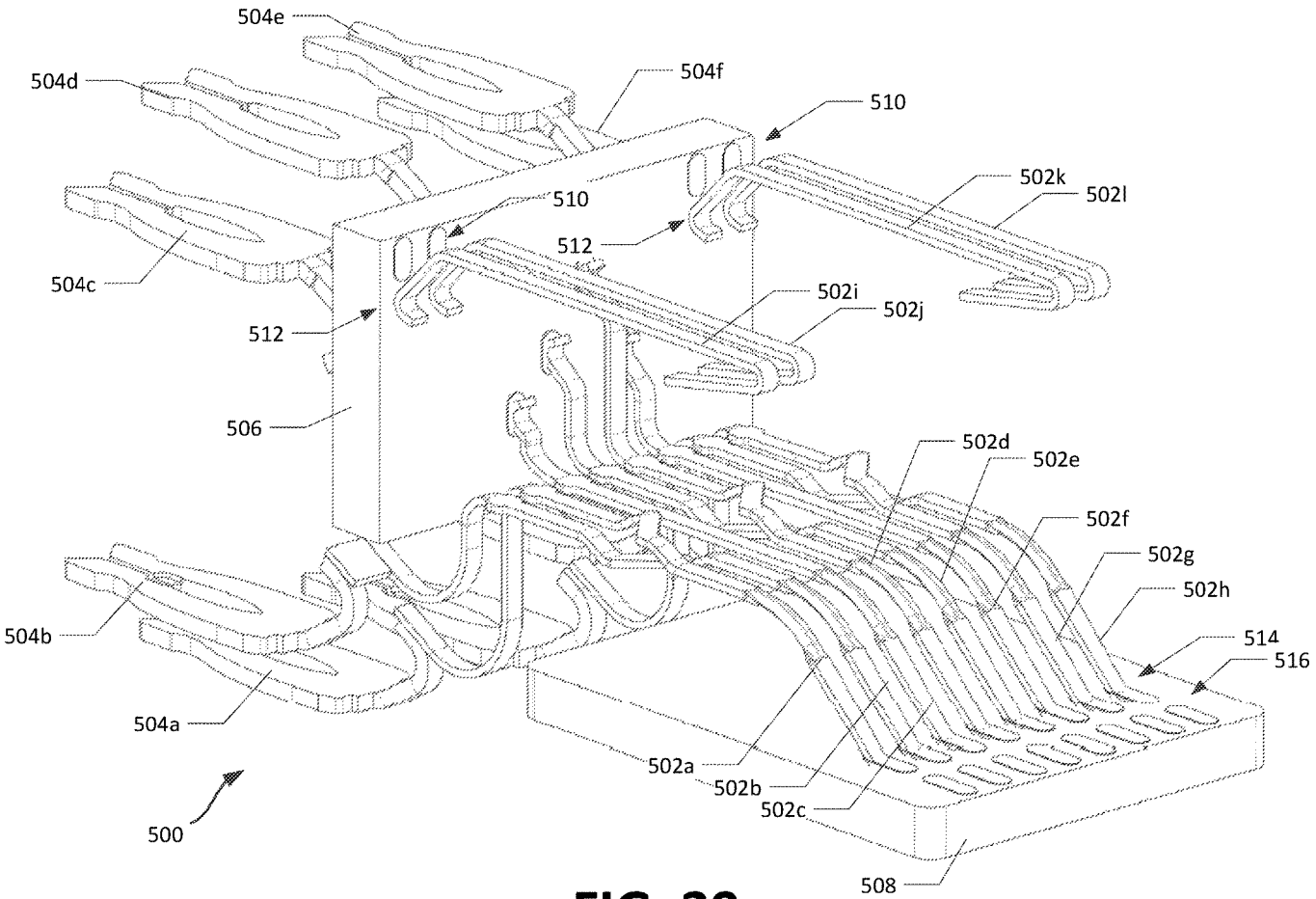
FIG. 39 is a perspective view of a telecommunications jack assembly configured to receive an RJ-45 or IEC 60603-7-7-compliant plug, and positioned in a first position.
Figure 40:
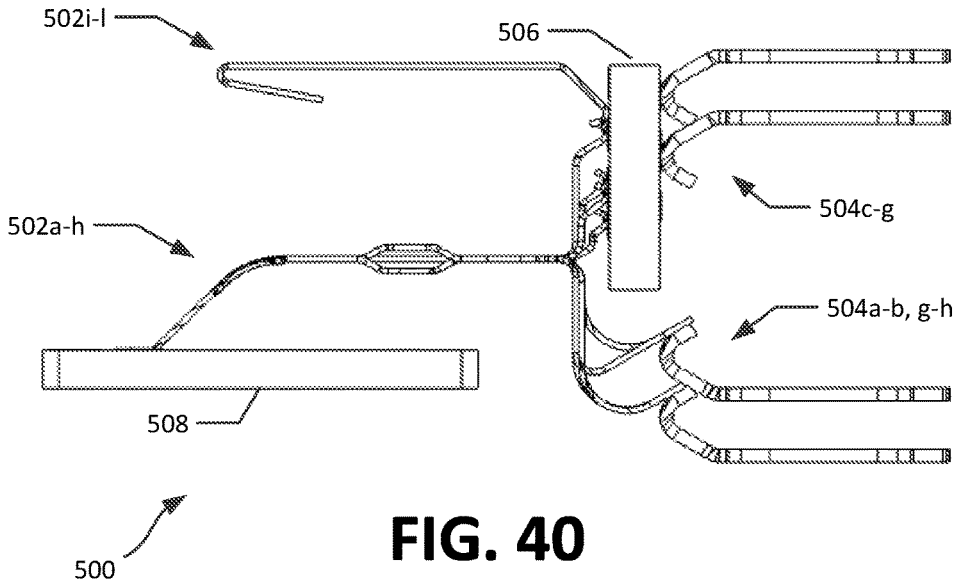
FIG. 40 is a right side plan view of the telecommunications jack assembly of FIG. 39.
Figure 41:
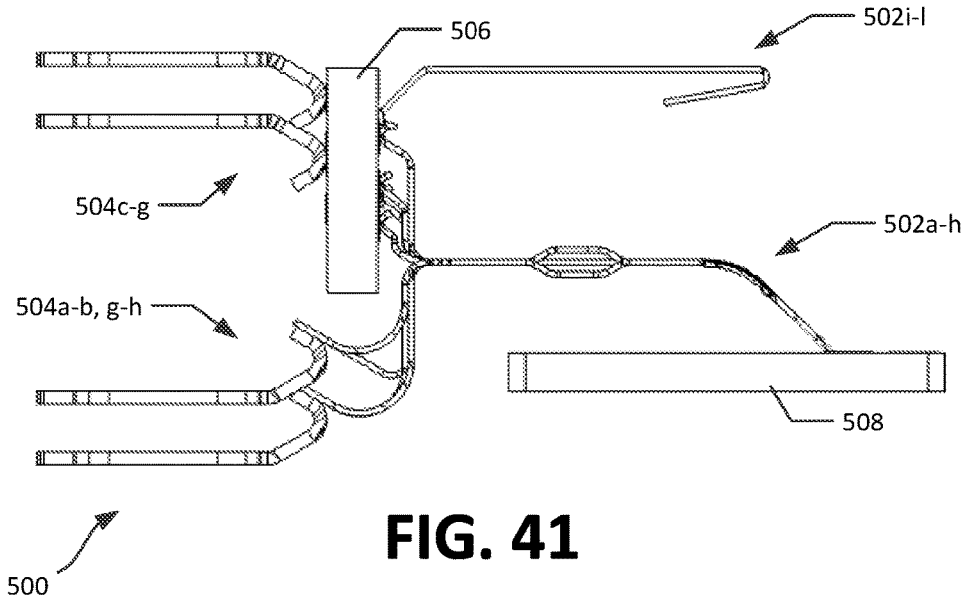
FIG. 41 is a left side plan view of the telecommunications jack assembly of FIG. 39.
Figure 42:
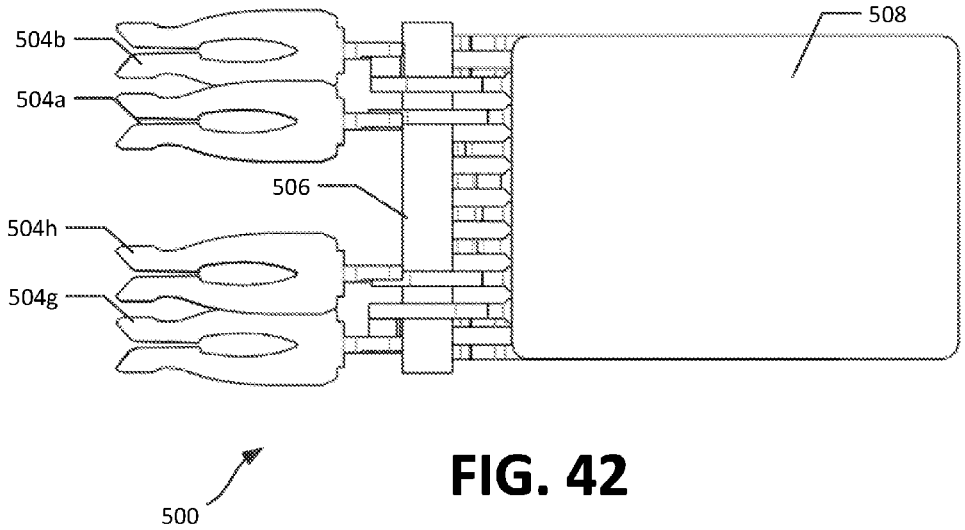
FIG. 42 is a bottom plan view of the telecommunications jack assembly of FIG. 39.
Figure 43:
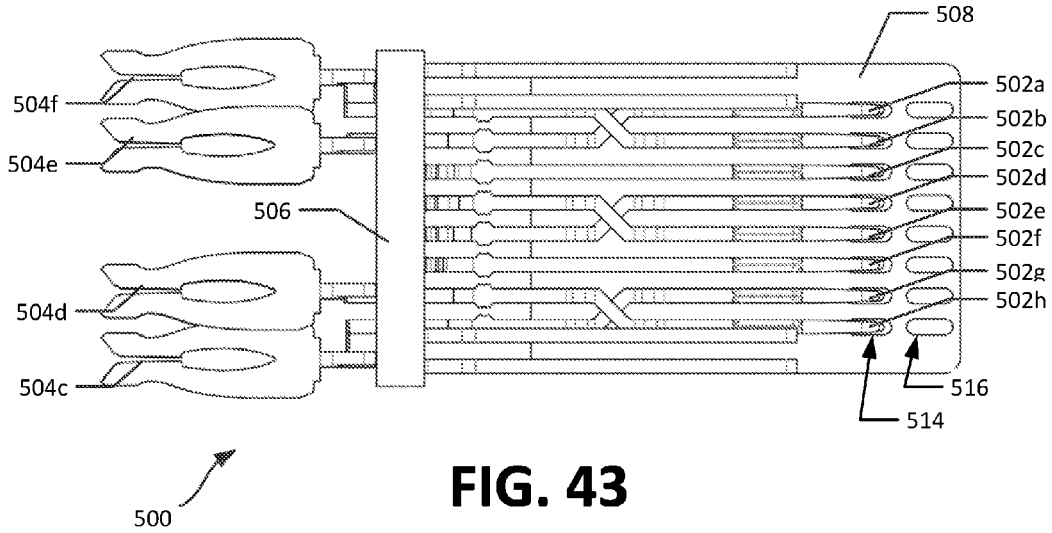
FIG. 43 is a top plan view of the telecommunications jack assembly of FIG. 39.
Figure 44:
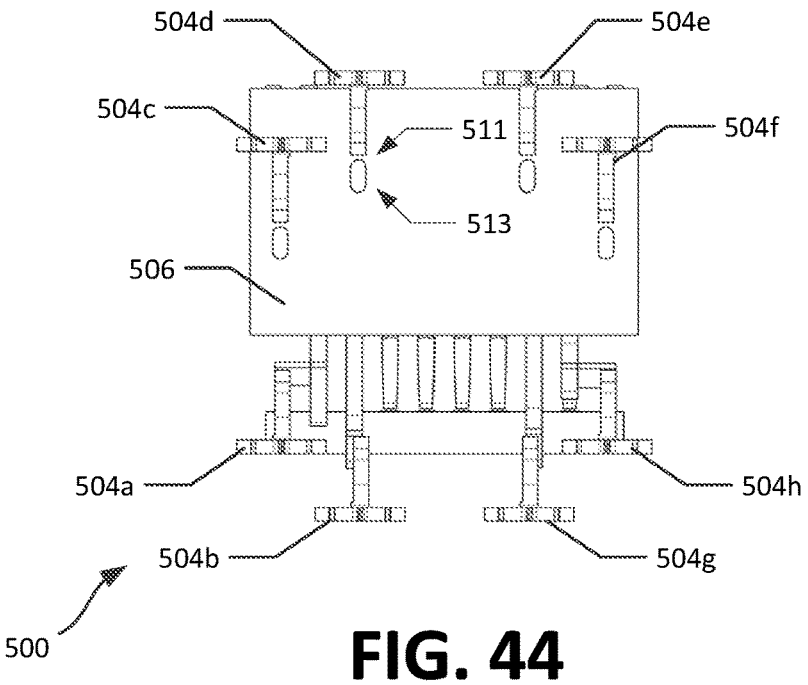
FIG. 44 is a rear plan view of the telecommunications jack assembly of FIG. 39.
Figure 45:
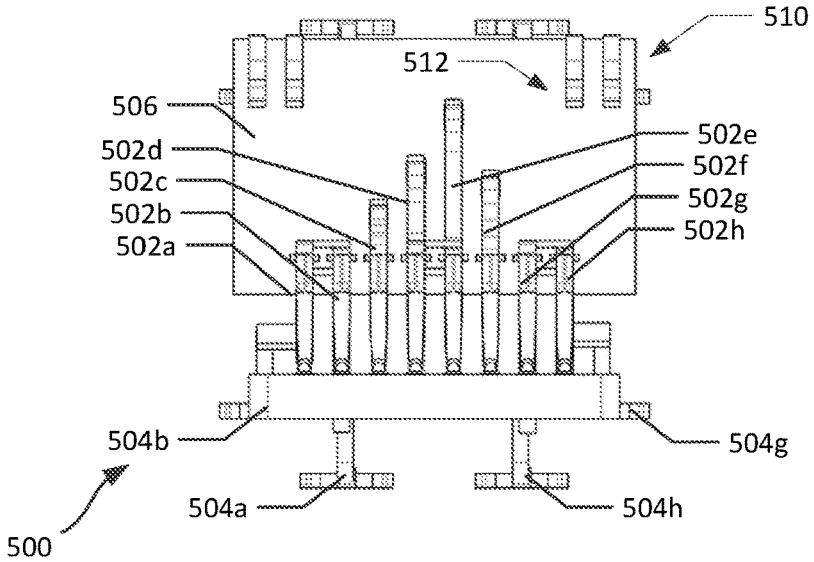
FIG. 45 is a front plan view of the telecommunications jack assembly of FIG. 39.
Figure 46:
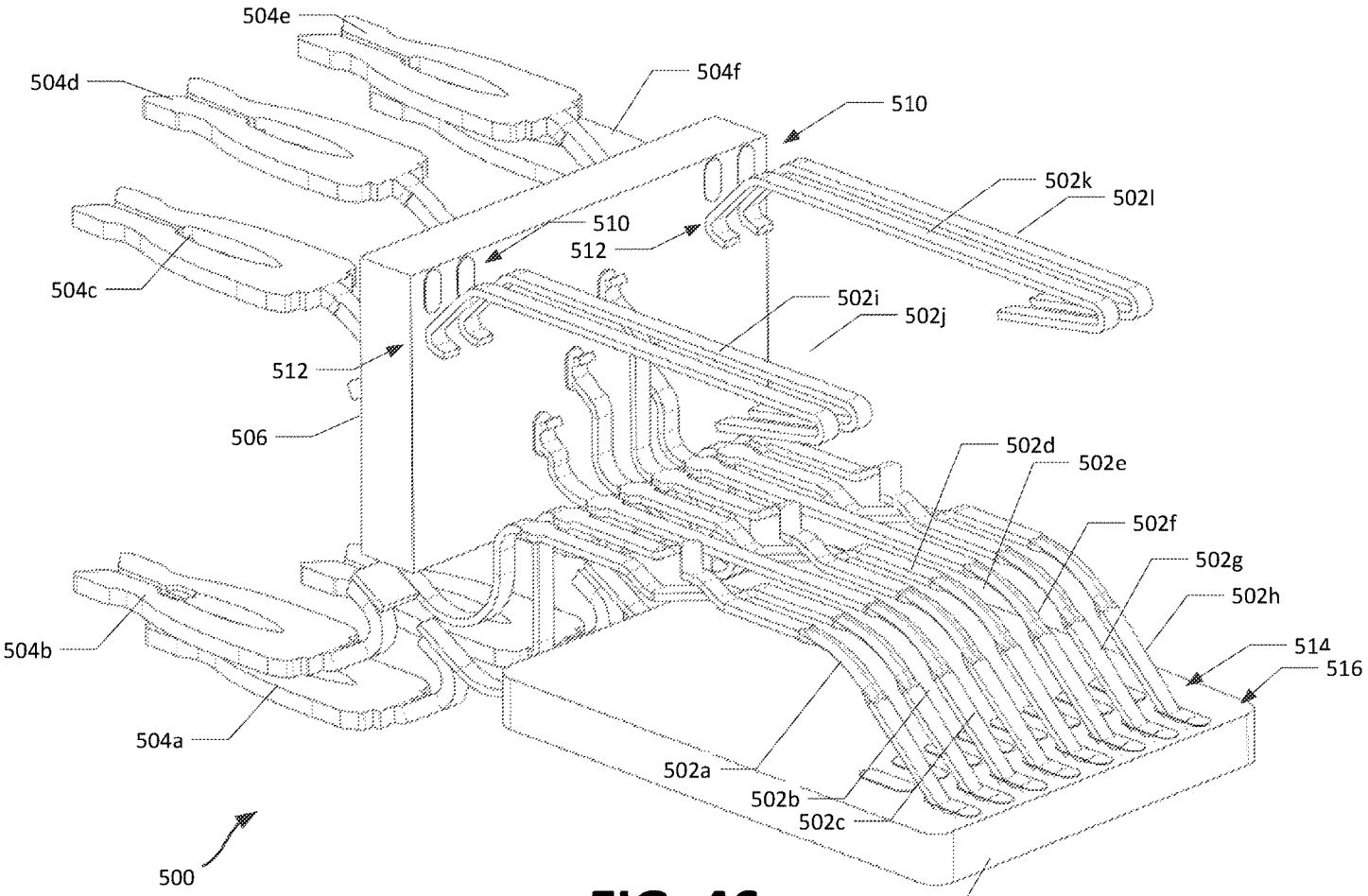
FIG. 46 is a perspective view of a telecommunications jack assembly configured to receive an RJ-45 or IEC 60603-7-7-compliant plug, and positioned in a second position.
Figure 47:
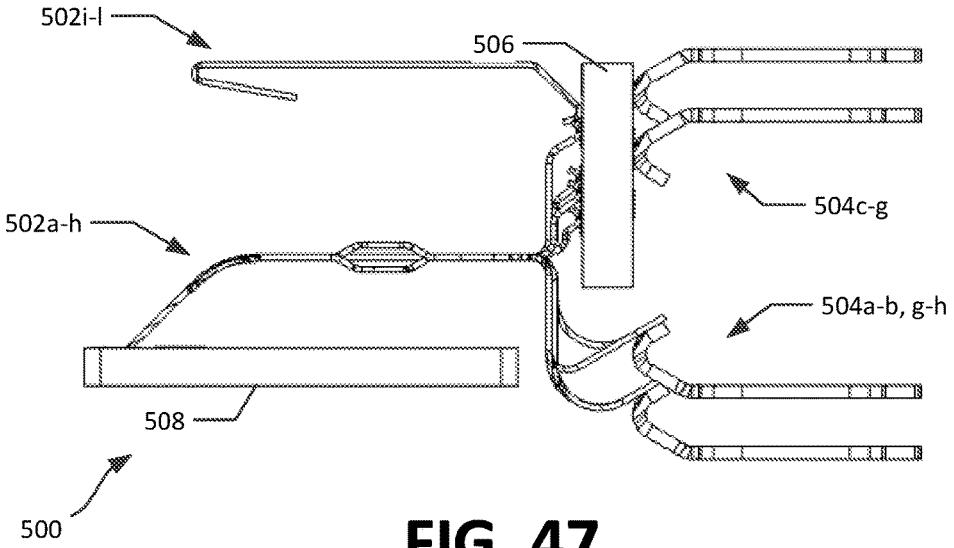
FIG. 47 is a right side plan view of the telecommunications jack assembly of FIG. 46.
Figure 48:
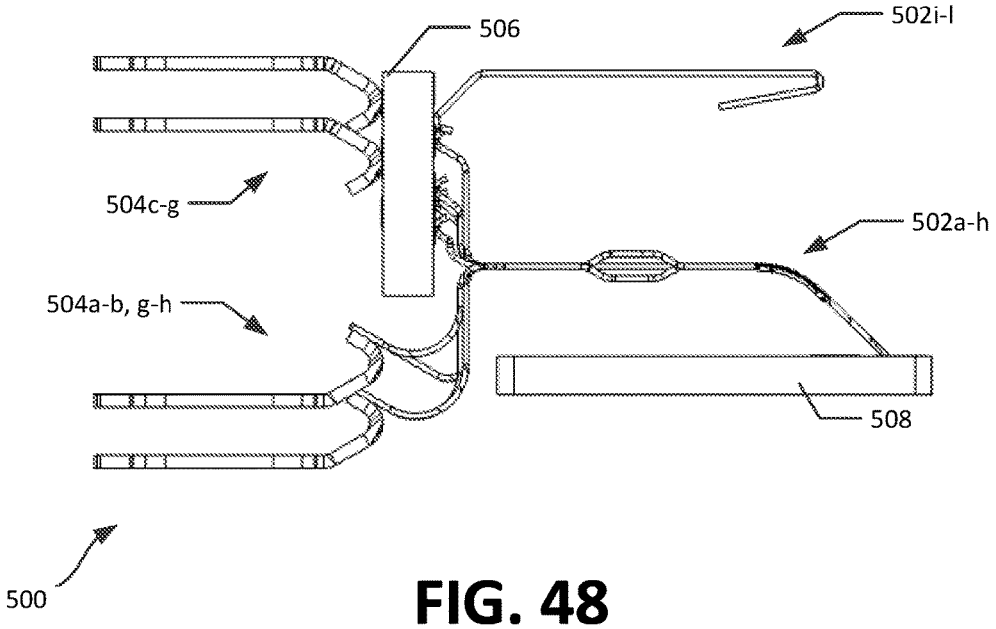
FIG. 48 is a left side plan view of the telecommunications jack assembly of FIG. 46.
Figure 49:
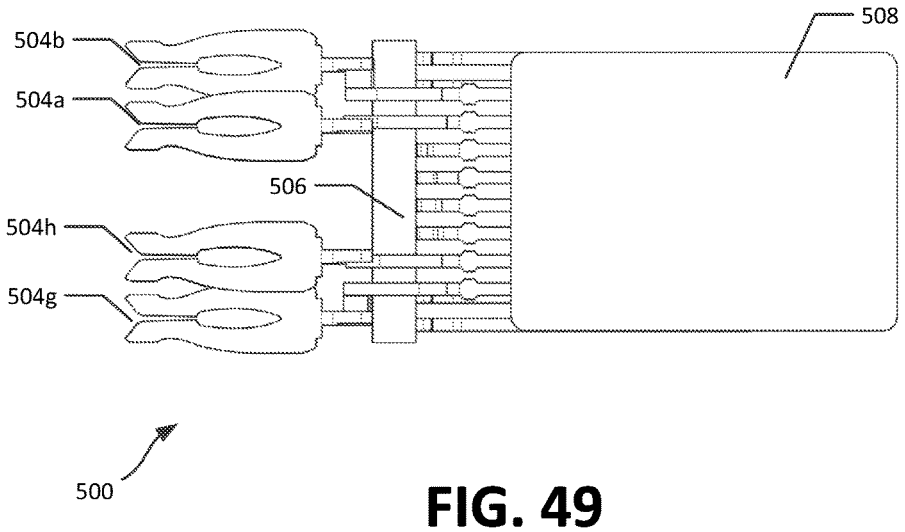
FIG. 49 is a bottom plan view of the telecommunications jack assembly of FIG. 46.
Figure 50:
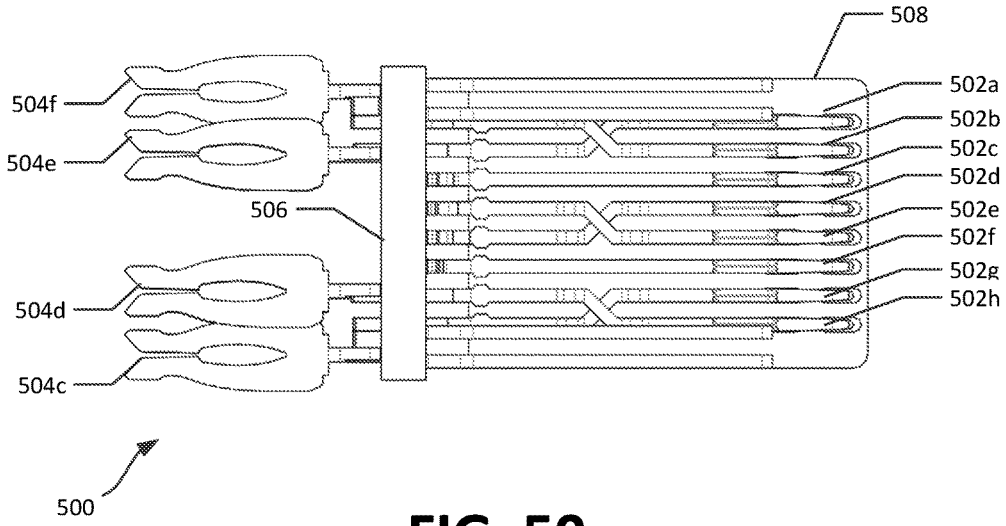
FIG. 50 is a top plan view of the telecommunications jack assembly of FIG. 46.
Figure 51:
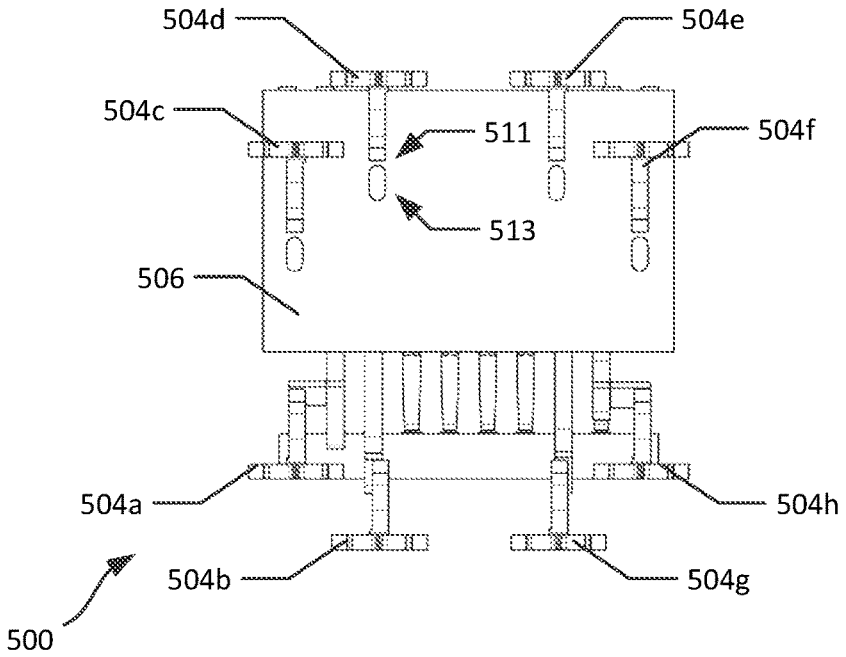
FIG. 51 is a rear plan view of the telecommunications jack assembly of FIG. 46.
Figure 52:
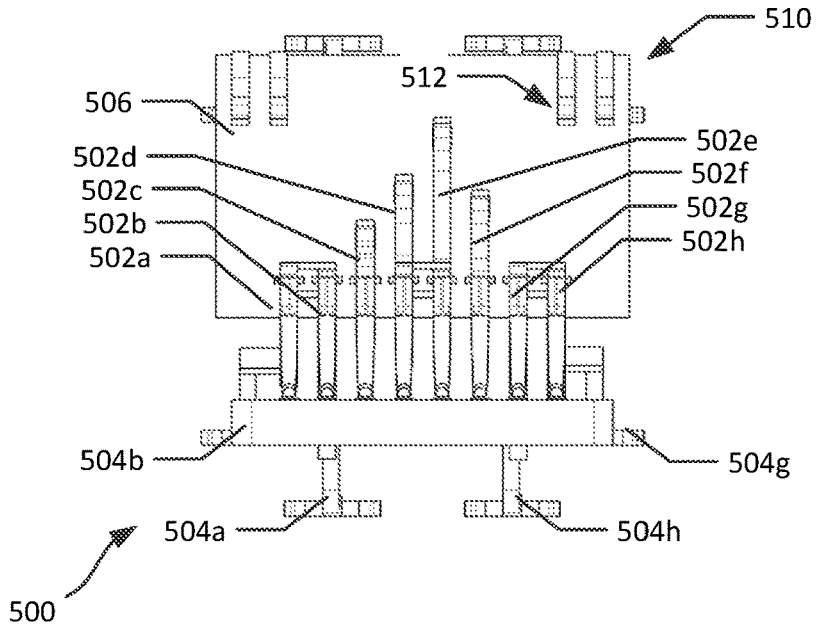
FIG. 52 is a front plan view of the telecommunications jack assembly of FIG. 46.

As previously noted, in some embodiments, the first circuit board 106 can be used to reassign contact pairs. Such an arrangement is illustrated in FIGS. 37-38. In particular, in FIG. 37, a schematic contact pair assignment 400 is shown, illustrating a conventional RJ-45 pair assignment, with a first contact pair 402*a* assigned to contact springs 1-2, a second contact pair 402*b* assigned to contact springs 3-6, a third contact pair 402*c* assigned to contact springs 4-5, and a fourth contact pair 402*d* assigned to contact springs 7-8. This can be, for example, the arrangement provided when a first circuit board is located in a first position, with contact spring 102*c* connected to insulation displacement connector 104*c*, contact spring 102*d* connected to insulation displacement connector 104*d*, contact spring 102*e* connected to insulation displacement connector 104*e*, and contact spring 102*f* connected to insulation displacement connector 104*f*. In contrast, as seen in contact pair assignment 450 of FIG. 38, the middle pairs (i.e., pairs 402*b-c*) are reassigned, with the second contact pair 402*b* assigned to contact springs 3-4, and third contact pair 402*c* assigned to contact springs 5-6. This can result in rearrangement of the routing between contact springs and insulation displacement connectors, such that contact spring 102*c* is connected to insulation displacement connector 104*c*, contact spring 102*d* connected to insulation displacement connector 104*f*, contact spring 102*e* connected to insulation displacement connector 104*d*, and contact spring 102*f* connected to insulation displacement connector 104*e*. In such embodiments, the second circuit board 108 can, if used, be used to apply different crosstalk compensation arrangements to one to all of the contacts 102*a-h*, rather than being used for pair assignment. Again, as noted above, the assignment/reassignment of pairs or rearrangement of routing can be selectably assigned to the first and second positions, respectively.

Referring now to FIGS. 39-52, alternative arrangements of a telecommunications jack subassembly 500 are illustrated that are compatible with a IEC 60603-7-7-compliant plug, rather than the RJ-45 plug arrangements of FIGS. 4-37. In the embodiment shown, a plurality of contact springs, shown as first, second, third, fourth, fifth, sixth, seventh, and eighth contact springs 502*a-h* are arranged consecutively along an array, and four additional contact springs, denoted as ninth, tenth, eleventh, and twelfth contact springs 502*i-l* are positioned to extend along an opposite side of a port when the telecommunications jack subassembly 500 is installed in a jack. In this embodiment, eight corresponding wire termination contacts, shown as first, second, third, fourth, fifth, sixth, seventh, and eighth insulation displacement contacts 504*a-h*, are shown as well.

In this embodiment, the telecommunications jack subassembly 500 has first and second circuit boards 506, 508, movable between first and second positions, analogous to the arrangement discussed above. The telecommunications jack subassembly 500 can also be used in the telecommunications jack assembly 100, including the engagement section 110. As above, contact springs 502*a-b* and 502*g-h* are continually electrically connected to corresponding insulation displacement connectors 504*a-b* and 504*g-h*, respectively.

However, in the embodiment shown, the first circuit board 506 has first and second contact pads 510, 512 on a first side of the circuit board, and contact pads 511, 513 on a second side of the circuit board. As seen in FIGS. 39-45, in a first position the first circuit board 506 causes electrical connection between the third, fourth, fifth, and sixth contact springs 502*c-f* and third, fourth, fifth, and sixth insulation displacement connectors 504*c-f*, respectively. This is due to connection between the third, fourth, fifth, and sixth contact springs 502*c-f* and contact pads 510, as well as connection between the third, fourth, fifth, and sixth insulation displacement connectors 504*c-f* and corresponding contact pads 511 on the circuit board 506. However, in a second position, the first circuit board causes electrical connection between the ninth, tenth, eleventh, and twelfth contact springs 502*i-l* and third, fourth, fifth, and sixth insulation displacement connectors 504*c-f*, respectively. In particular, when the circuit board 506 is in the second position, the ninth, tenth, eleventh, and twelfth contact springs 502*i-l* electrically connect to second contact pads 512, and third, fourth, fifth, and sixth contact springs 502*c-g* contact an insulator (i.e., are disconnected). At the same time, third, fourth, fifth, and sixth insulation displacement connectors 504*c-f* are electrically connected to contact pads 513, which are electrically routed to contact pads 512 within the circuit board. As such, movement of the first circuit board 506 between first and second positions selectively activates different sets of contact springs.

Figure 53:
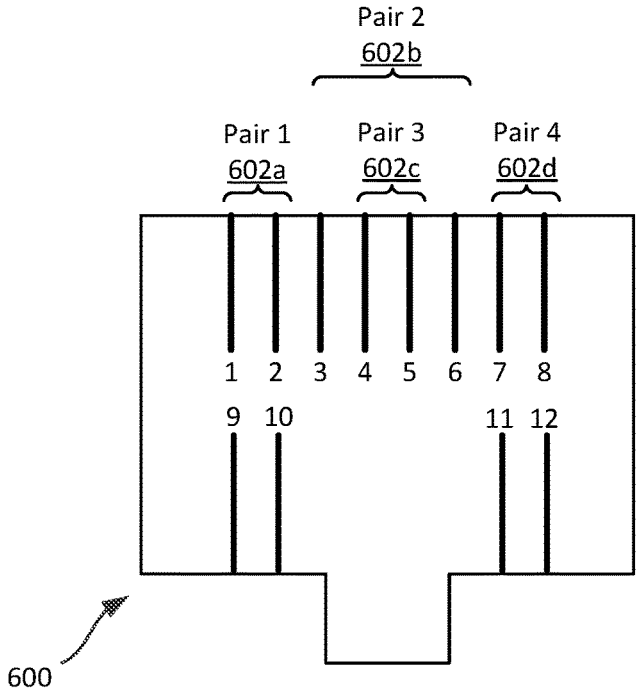
FIG. 53 is a schematic illustration of a pin assignment in a telecommunications jack such as may use an assembly of FIGS. 39-52, when a circuit board is located in a first position, according to an example embodiment.
Figure 54:
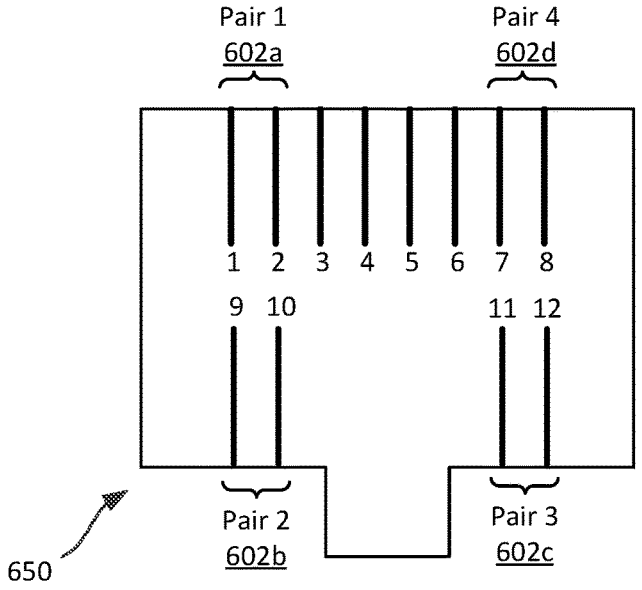
FIG. 54 is a schematic illustration of a pin assignment different from that of FIG. 53, when a circuit board is located in a second position, according to an example embodiment.

As noted above, in some embodiments, a first circuit board 506 can be used to reassign contact pairs. Such an arrangement is illustrated in FIGS. 53-54. In particular, in FIG. 53, a schematic contact pair assignment 600 is shown, illustrating a conventional RJ-45 pair assignment in a system that can accommodate a IEC 60603-7-7-compliant format connector. In this arrangement a first contact pair 602*a* is assigned to contact springs 1-2, a second contact pair 602*b* is assigned to contact springs 3-6, a third contact pair 602*c* is assigned to contact springs 4-5, and a fourth contact pair 602*d* is assigned to contact springs 7-8. This can be, for example, the arrangement provided when a first circuit board is located in a first position, with contact spring 502*c* connected to insulation displacement connector 504*c*, contact spring 502*d* connected to insulation displacement connector 504*d*, contact spring 502*e* connected to insulation displacement connector 504*e*, and contact spring 502*f* connected to insulation displacement connector 504*f*. In contrast, as seen in contact pair assignment 650 of FIG. 54, the middle pairs are reassigned, with the second contact pair 602*b* assigned to contact springs 9-10, and third contact pair 602*c* assigned to contact springs 11-12. This can result in rearrangement of the routing between contact springs and insulation displacement connectors, such that contact springs 502*c-f* disconnected, and contact spring 502*i* is connected to insulation displacement connector 504*c*, contact spring 502*j* connected to insulation displacement connector 504*f*, contact spring 502*k* connected to insulation displacement connector 504*d*, and contact spring 502*l* connected to insulation displacement connector 504*e*.

As in the previously-discussed embodiments, the second circuit board 508 can be used to provide crosstalk compensation of different types, depending upon whether the second circuit board is placed in first or second positions. For example, in a first position, the second circuit board 508 can include crosstalk compensation connected to contact pads 514 for signal frequencies up to about 500 MHz; example crosstalk compensation arrangements are discussed in U.S. Pat. Nos. 7,381,098, 7,402,085, 7,787,615, and 8,151,457, the disclosures of which were previously incorporated by reference. In a second position, the second circuit board may only include crosstalk compensation for the outer pairs, i.e., associated with contact springs 502*a-b* and 502*g-h*, via contact pads 516, since contact springs 502*c-f* will be disconnected. In such embodiments, crosstalk compensation may also be applied between contact pads 512, 513 on the first circuit board 506, in case crosstalk on the second and third contact pairs 602*b*, 602*c* is desired.

Figure 55:
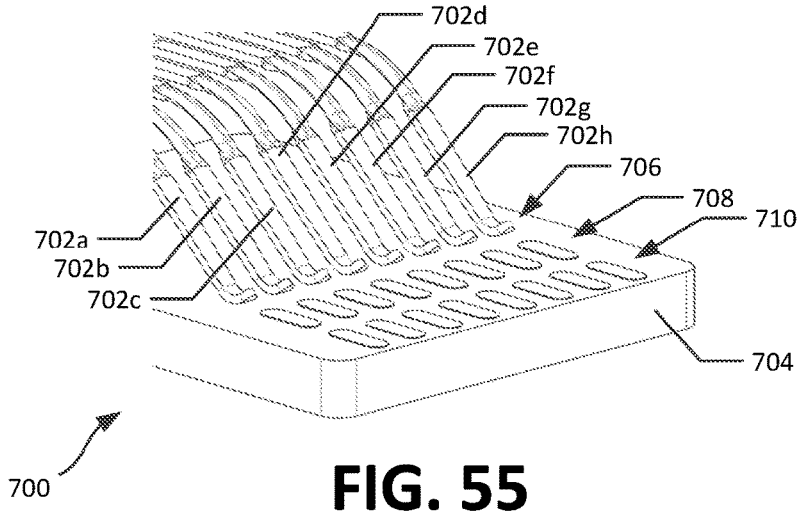
FIG. 55 is a close-up view of a portion of contact springs engaging with a portion of a circuit board at an insulation layer.
Figure 56:
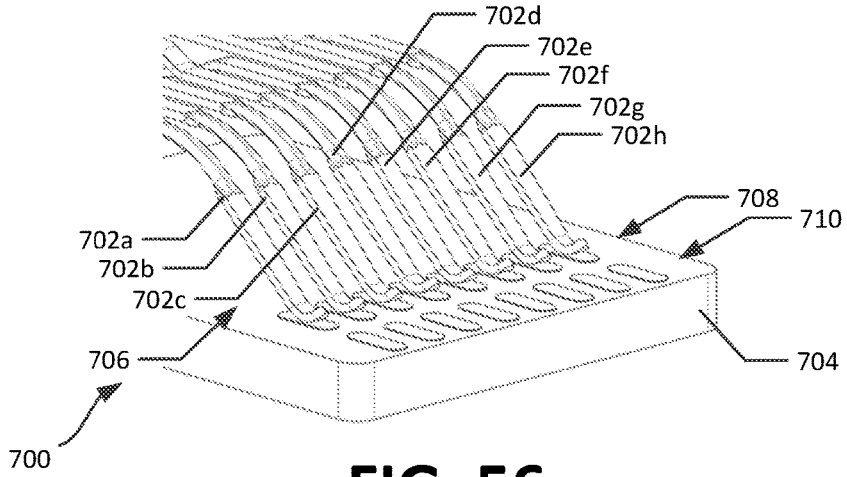
FIG. 56 is a close-up view of portions contact springs engaging with a portion of a circuit board at a first set of contact pads.
Figure 57:
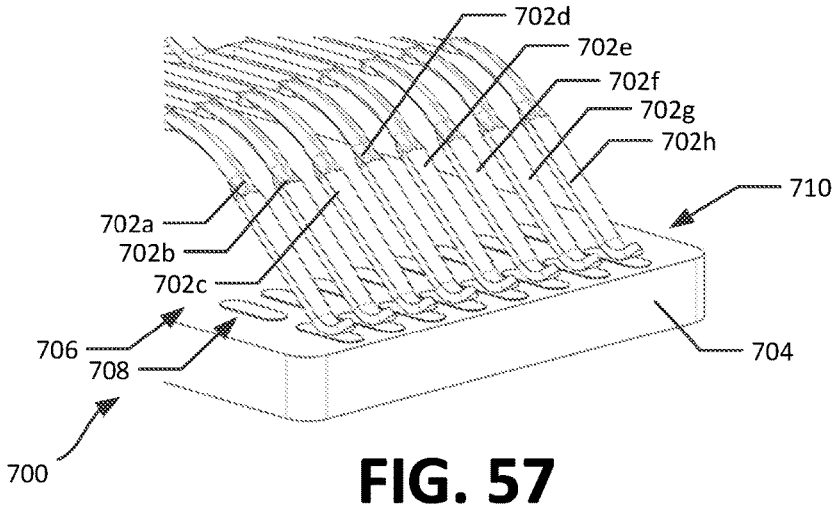
FIG. 57 is a close-up view of portions of contact springs engaging with a portion of a circuit board at a second set of contact pads.

FIGS. 55-61 illustrate further example switching arrangements that can be used according to the principles of the present disclosure, either by avoiding use of multiple contact pads, or by extending use of such contact pads for additional applications. For example, FIGS. 55-57 illustrate a three-position configuration in which contact springs 702*a-h* contact a circuit board 704, either at an insulating layer 706 (FIG. 55), a first set of contact pads 708 (FIG. 56), or a second set of contact pads 710 (FIG. 57). Using this arrangement, any of three different crosstalk compensation arrangements can be used, thereby further increasing the number of types of crosstalk compensation arrangements that are possible. For example, in the arrangement of FIG. 55, no crosstalk compensation is applied by circuit board 704; any such compensation may be applied directly to the contact springs, or via another circuit board, or some other arrangement. In the arrangement of FIGS. 56-57, different crosstalk compensation arrangements or pin assignments can be provided that are tailored to particular desired signal frequencies. As such, three different variations, applying crosstalk tailored to three different signal frequency ranges, could be used.

Figure 58:
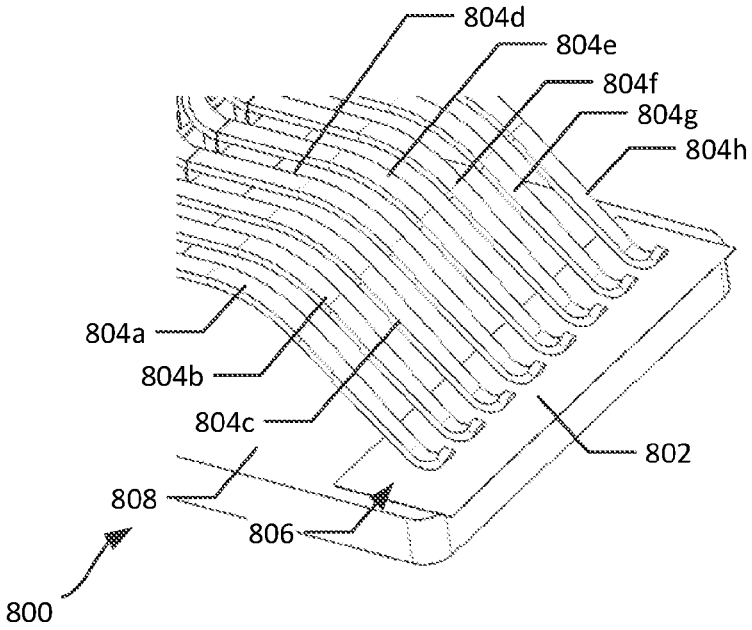
FIG. 58 is a close-up view of portions of contact springs engaging with an insulating pad inserted between the contact springs and a circuit board.
Figure 59:
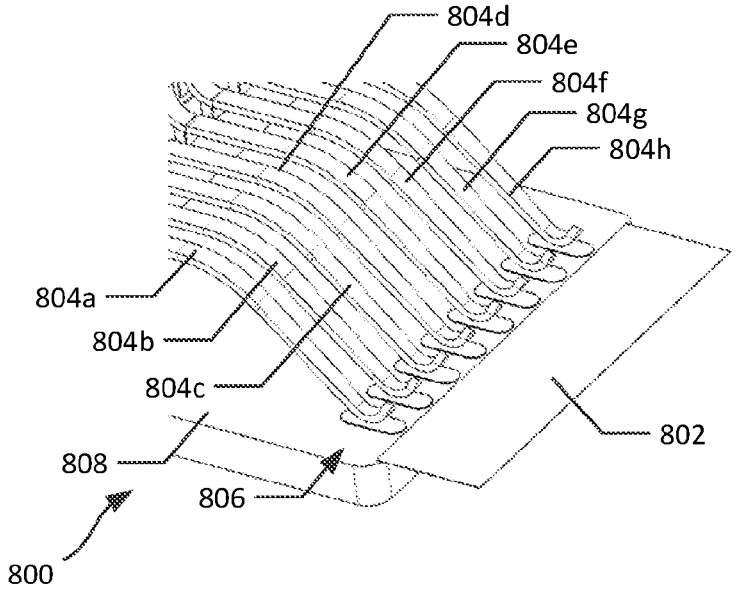
FIG. 59 is a close-up view of portions of contact springs engaging with contact pads of a circuit board, with the insulating pad of FIG. 58 removed.
Figure 60:
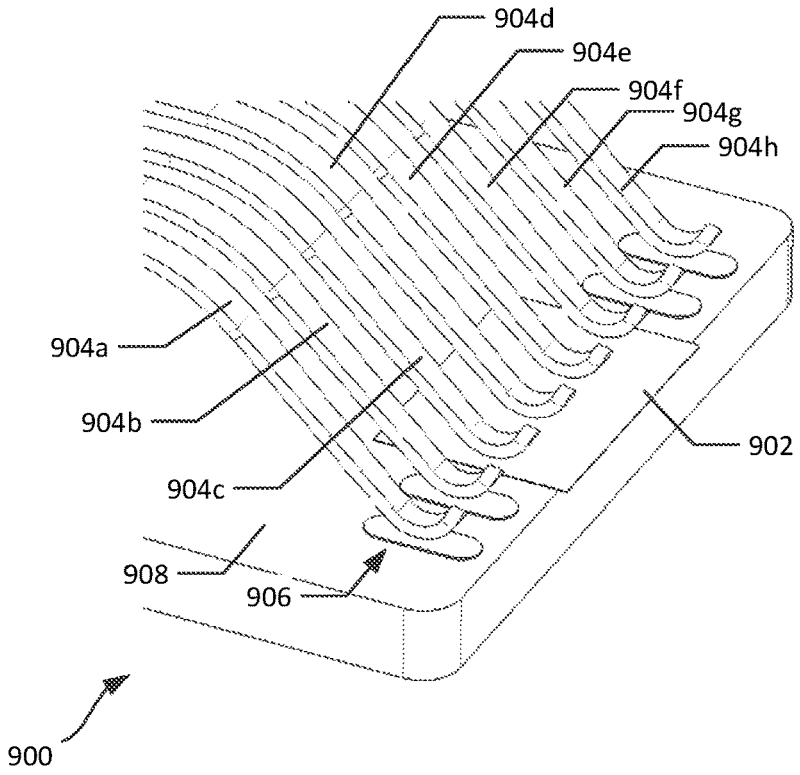
FIG. 60 is a close-up view of portions of contact springs engaging with an insulating pad inserted between third, fourth, fifth, and sixth contact springs and a circuit board.
Figure 61:
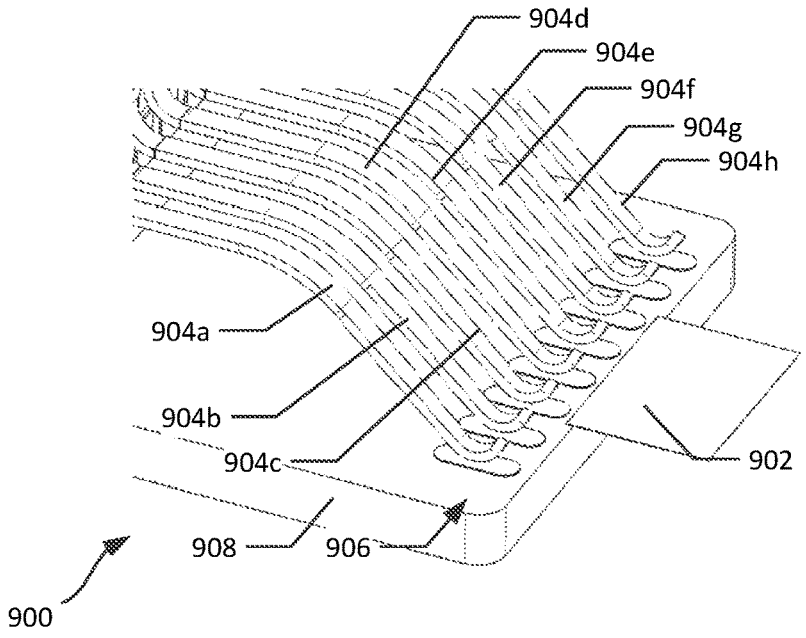
FIG. 61 is a close-up view of portions of third, fourth, fifth, and sixth contact springs engaging with contact pads of a circuit board, with the insulating pad of FIG. 60 removed.

FIGS. 58-62 illustrate example configurations in which an insulating layer can be moveable between first and second positions to affect electrical connection between contact springs and circuits disposed on a circuit board. In FIGS. 58-59, a first arrangement 800 shows an insulating pad 802 selectively positioned or removed from between contact springs 804*a-h* and contact pads 806 of a circuit board 808, thereby selectively connecting the contact springs 804*a-h* to a circuit formed at the contact pads 806. In FIGS. 60-61, an arrangement 900 shows an insulating pad 902 selectively positioned or removed from between contact springs 804*c-f*, and corresponding contact pads 906 of a circuit board 908. In this arrangement, fewer than all of the contact springs 904*a-h* are disconnected from the contact pads 906 upon insertion of the insulating pad 902, thereby changing the circuitry connected to fewer than all contact springs (and resulting signal pairs).

Figure 62:
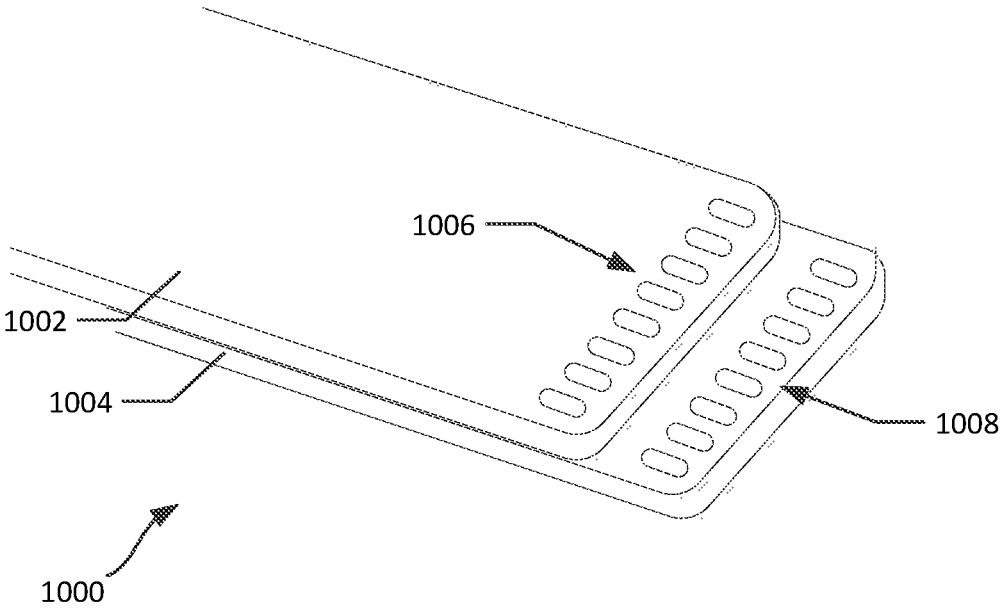
FIG. 62 is a close-up view of a further arrangement of first and second circuit boards causing a switching arrangement between contact pads.

In FIG. 62, an arrangement 1000 is illustrated showing first and second circuit boards 1002, 1004, respectively. The first circuit board 1002 has first contact pads 1006, and the second circuit board 1004 has second contact pads 1008. In the embodiment shown, the first circuit board is moveable relative to the second circuit board (or vice versa) to cause selective connection between the second contact pads 1008 and contact pads on an underside of the first circuit board 1002 (not shown), thereby provide a selective electrical connection between contact springs (also not shown, but generally disposed as illustrated in FIGS. 58-61) electrically connected to the first contact pads 1006 and a circuit on the second circuit board 1004.

It is noted that any of the configurations illustrated in FIGS. 55-62 can use an engagement section 110, as illustrated above, to move the circuit board, contact springs, or insulating layer among two or more positions, to cause selectable electrical connection between contact springs and a circuit board, for example to cause rerouting of pin assignments and/or connecting or disconnecting crosstalk compensation.

Figure 63:
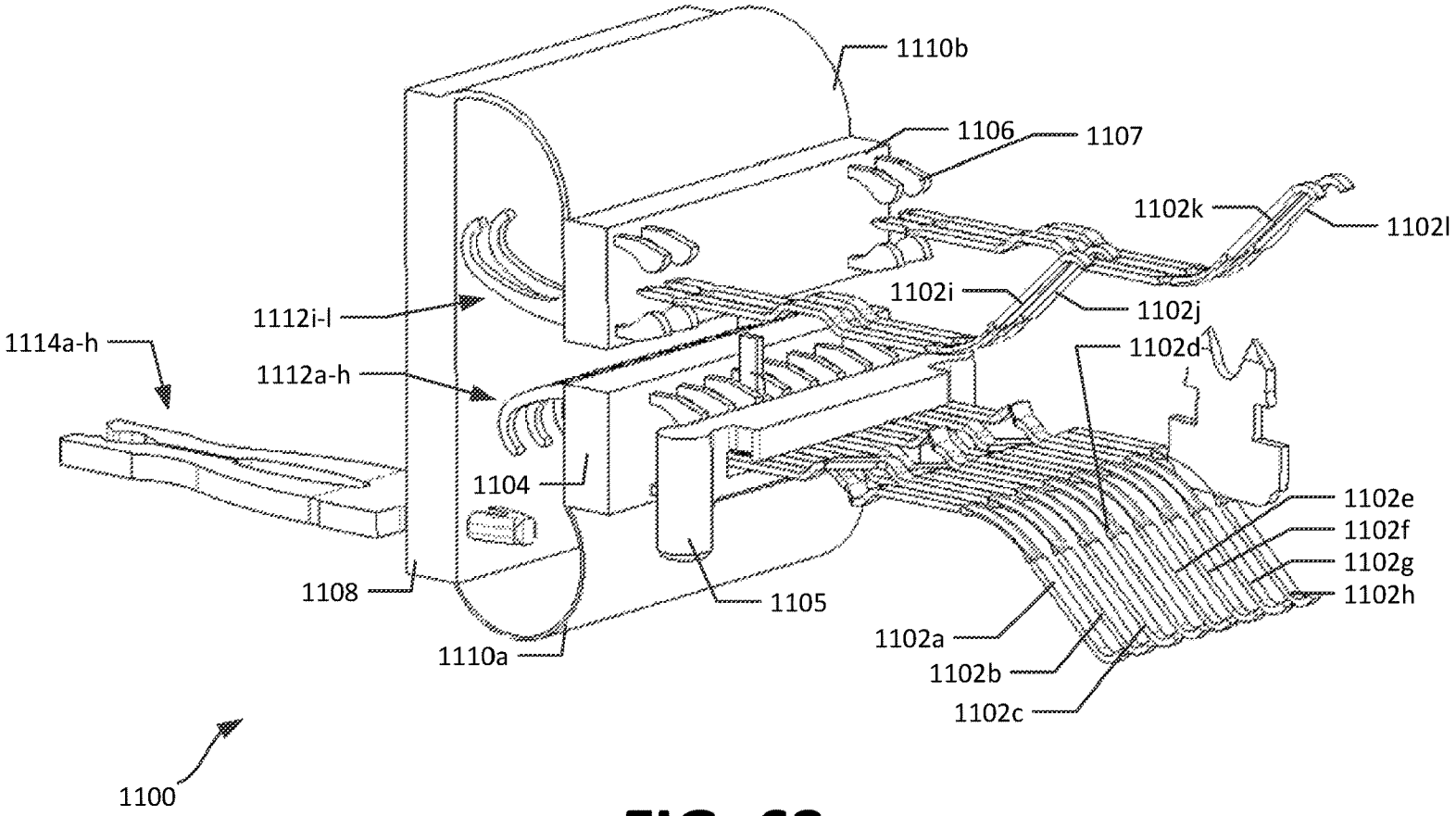
FIG. 63 is a perspective view of a telecommunications jack assembly including flex circuitry and useable in the telecommunications jack of FIGS. 1-4, according to a still further alternative embodiment of the present disclosure.
Figure 64:
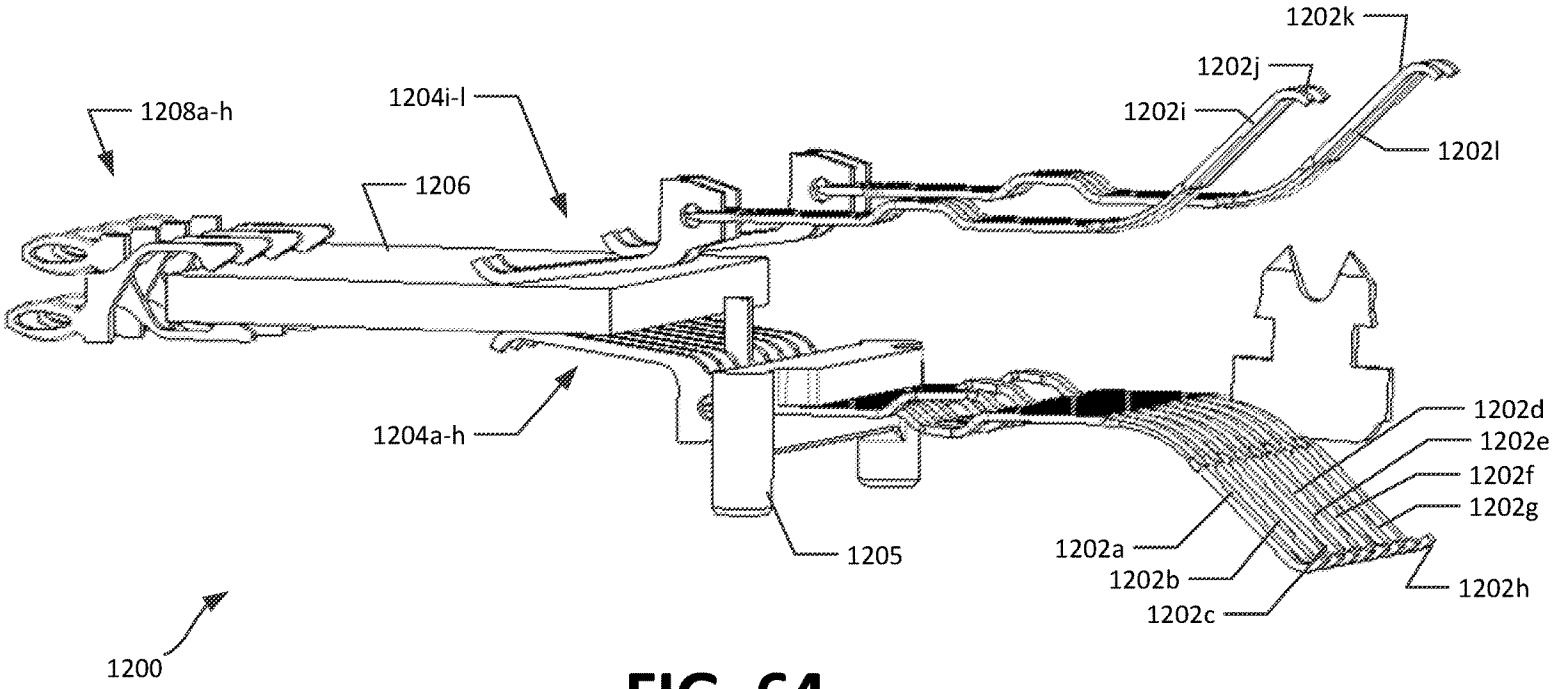
FIG. 64 is a perspective view of a telecommunications jack assembly having a circuit board oriented along a direction of insertion of a plug, and useable in the telecommunications jack of FIGS. 1-4, according to a still further alternative embodiment of the present disclosure.

Referring now to FIGS. 63-64, additional alternative embodiments of switching telecommunications jack assemblies are shown. In FIG. 63, a telecommunications jack assembly 1100 is shown that uses flex circuitry to allow actuation between first and second circuit arrangements. In this embodiment, first, second, third, fourth, fifth, sixth, seventh, and eighth contact springs 1102*a-h* are arranged consecutively along an array, and four additional contact springs, denoted as ninth, tenth, eleventh, and twelfth contact springs 1102*i-l* are positioned to extend along an opposite side of a port when the telecommunications jack subassembly 1100 is installed in a jack, for example to selectively use RJ-45 and/or IEC 60603-7-7-compliant plug connectors with the jack. The contact springs 1102*a-h* are mounted in a first chassis 1104 and the contact springs 1102*i-l* are mounted in a second chassis 1106, with each chassis connected to a circuit board 1108 via flex circuitry 1110*a-b*, respectively. Each chassis also includes contacts 1112*a-l* extending toward the circuit board, each associated with a corresponding contact spring 1102*a-l*. Corresponding contact pads (not shown) on the circuit boar electrically connect between positions behind the contacts 1112*a-l* and a set of eight insulation displacement connectors 1114*a-h* (only one of which is shown for convenience).

The first chassis 1104 has a first projection 1105 extending toward the end of the contact springs 1102*a-h*, such that, when used in a jack 10, it extends into the port 14. The second chassis 1106 has a second projection 1107 similarly extending toward the end of the contact springs 1002*i-l*, but extending a second distance different from the first distance. When a standard RJ-45 plug is inserted into a jack that includes the jack subassembly 1100, the first projection 1105 will be engaged by the plug body, causing electrical connection between contacts 1110*a-h*. However, the second projection 1107 is positioned such that the second chassis is not moved toward the circuit board 1108. When a shaped IEC 60603-7-7-compliant jack is inserted into such a jack having the jack assembly 1100, both the first and second projections 1105, 1107 are engaged, and therefore contact springs 1102*i-l* are electrically connected and/or activated via contact between the contacts 1112*i-l* and the circuit board 1108, via contact pads.

It is noted that, in this embodiment, in addition to circuitry on the circuit board 1108, additional crosstalk compensation and/or routing circuitry can be included on the flex circuitry 1110*a-b*, as well.

In FIG. 64, a telecommunications jack assembly 1200 is shown in which a further circuit board arrangement is contemplated. In particular, in the embodiment shown, first, second, third, fourth, fifth, sixth, seventh, and eighth contact springs 1202*a-h* are arranged consecutively along an array, and four additional contact springs, denoted as ninth, tenth, eleventh, and twelfth contact springs 1202*i-l* are positioned to extend along an opposite side of a port when the telecommunications jack subassembly 1200 is installed in a jack, for example to selectively use RJ-45 and/or IEC 60603-7-7-compliant plug connectors with the jack. The contact springs 1202*a-l* have electrical leads 1204*a-l* at tail portions that electrically connect to contact pads (not shown) on a circuit board 1206 that is oriented lengthwise in the direction of insertion of a plug into a jack in which the jack assembly 1200 is used. The circuit board 1206 is similarly electrically connected, at an opposite edge, to insulation displacement connectors 1208*a-h*. The circuit board 1206 is movable between first and second positions in a direction generally parallel with a direction of insertion of a plug, such that contact pads on the circuit board are selectively connected between the leads 1204*a-h*, or leads 1204*a-b*, 1204*g-h*, and 1204*i-l*, respectively, depending on the position of the board, in a similar manner to that described above, allowing for connection to insulation displacement contacts 1208*a-h*, respectively, upon insertion of a plug.

It is noted that, although some specific circuit arrangements are illustrated in the example embodiments of the present disclosure, it is recognized that additional types of switching circuit board arrangements are possible as well. Generally, the present disclosure contemplates movable circuit boards that are configured to allow for reconfigurations of circuits and/or circuit compensation to provide telecommunications jacks that are capable of use at increased signal frequencies while remaining compatible with existing communications standards. Accordingly, the present disclosure is not limited to the specific embodiments discussed herein, but rather are defined in the claims appended hereafter.

The above specification, examples and data provide a complete description of the manufacture and use of the composition of the invention. Since many embodiments of the invention can be made without departing from the spirit and scope of the invention, the invention resides in the claims hereinafter appended.

The invention claimed is:

1. A telecommunications jack adapted to receive a plug, the telecommunications jack comprising:

a housing defining a port for receiving the plug;

first, second, third, fourth, fifth, sixth, seventh and eighth consecutively arranged contact springs adapted to make electrical contact with the plug when the plug is inserted into the port of the housing along a first axis;

ninth, tenth, eleventh, and twelfth contact springs positioned apart from the first, second, third, fourth, fifth, sixth, seventh and eighth consecutively arranged contact springs and adapted to make electrical contact with a IEC 60603-7-7-compliant plug when the IEC 60603-7-7-compliant plug is inserted into the port;

first, second, third, fourth, fifth, sixth, seventh and eighth wire termination contacts for terminating wires to the jack;

a circuit board arrangement including first and second circuits, the circuit board arrangement including a circuit board moveable in a direction nonparallel with the first axis between first and second positions, wherein in the first position the circuit board electrically connects a first plurality of contact springs to the corresponding wire termination contacts via the first circuit, the first plurality of contact springs including at least the ninth, tenth, eleventh, and twelfth contact springs; and wherein in the second position the circuit board electrically connects a second plurality of contact springs to the corresponding wire termination contacts via the second circuit different from the first circuit and disconnects at least some of the first plurality of contact springs from corresponding wire termination contacts, the second plurality of contact springs including at least the third, fourth, fifth, and sixth contact springs.

2. The telecommunications jack of claim 1, wherein in the first position the circuit board electrically connects at least the third, fourth, fifth, and sixth contact springs to the third, fourth, fifth, and sixth wire termination contacts via the first circuit.

3. The telecommunications jack of claim 2, wherein in the second position the circuit board electrically connects at least the ninth, tenth, eleventh, and twelfth contact springs to the third, fourth, fifth, and sixth wire termination contacts via the second circuit on the circuit board different from the first circuit.

4. The telecommunications jack of claim 1, wherein in the first position, the ninth, tenth, eleventh, and twelfth contact springs are electrically disconnected from the third, fourth, fifth, and sixth wire termination contacts.

5. The telecommunications jack of claim 4, wherein in the second position, the third, fourth, fifth, and sixth contact springs are electrically disconnected from the third, fourth, fifth, and sixth wire termination contacts.

6. The telecommunications jack of claim 1, wherein the first circuit provides a first crosstalk compensation that compensates for crosstalk occurring at frequencies of about 1-500 MHz, and wherein the second circuit provides a second crosstalk compensation that compensates for crosstalk occurring at frequencies in excess of about 500 MHz.

7. The telecommunications jack of claim 1, wherein, in the first position, the circuit board electrically disconnects at least some of the second plurality of contact springs from corresponding wire termination contacts.

8. A telecommunications jack adapted to receive a plug, the telecommunications jack comprising:

a housing defining a port for receiving the plug;

first, second, third, fourth, fifth, sixth, seventh and eighth consecutively arranged contact springs adapted to make electrical contact with the plug when the plug is inserted into the port of the housing along a first axis;

first, second, third, fourth, fifth, sixth, seventh and eighth wire termination contacts for terminating wires to the jack;

a circuit board having a plurality of contact pads, the plurality of contact pads in electrical contact with corresponding first, second, third, fourth, fifth, sixth, seventh and eighth consecutively arranged contact springs;

an insulating layer movable between first and second positions in a direction parallel with the first axis, wherein in a first position, the insulating layer is disposed between one or more of the contact springs and corresponding contact pads, and wherein in a second position, the insulating layer is removed from between the one or more contact springs and the corresponding contact pads.

9. The telecommunications jack of claim 8, wherein the one or more of the contact springs includes at least the third, fourth, fifth, and sixth contact springs.

10. The telecommunications jack of claim 8, wherein the contact pads are electrically connected to a crosstalk compensating circuit on the circuit board.

* * * * *